US008582989B2

(12) United States Patent
Suda

(10) Patent No.: US 8,582,989 B2
(45) Date of Patent: Nov. 12, 2013

(54) IMAGE FORMING APPARATUS WITH REPLACEABLE DEVELOPER HOLDER

(75) Inventor: Yasuhiro Suda, Fukushima (JP)

(73) Assignee: Oki Data Corporation, Tokyo (JP)

( * ) Notice: Subject to any disclaimer, the term of this patent is extended or adjusted under 35 U.S.C. 154(b) by 547 days.

(21) Appl. No.: 12/656,589

(22) Filed: Feb. 4, 2010

(65) Prior Publication Data

US 2010/0202788 A1 Aug. 12, 2010

(30) Foreign Application Priority Data

Feb. 6, 2009 (JP) ..... 2009-026310

(51) Int. Cl.
*G03G 15/00* (2006.01)
*G03G 15/08* (2006.01)

(52) U.S. Cl.
USPC ..... 399/27; 399/12

(58) Field of Classification Search
USPC ..... 399/12, 27
See application file for complete search history.

(56) References Cited

U.S. PATENT DOCUMENTS

2006/0216046 A1* 9/2006 Hatakeyama ..... 399/27

FOREIGN PATENT DOCUMENTS

| | | | |
|---|---|---|---|
| JP | 09-236981 | A | 9/1997 |
| JP | 2003-050505 | A | 2/2003 |
| JP | 2006-267528 | A | 10/2006 |

* cited by examiner

*Primary Examiner* — David Gray
*Assistant Examiner* — Andrew Do
(74) *Attorney, Agent, or Firm* — Rabin & Berdo, P.C.

(57) ABSTRACT

A process cartridge includes a toner reservoir. A first controller calculates a consumed amount of toner based on image data. A toner bottle is attached to the process cartridge. The toner bottle includes a toner chamber that holds the toner therein and supplies the toner into the reservoir. The toner bottle includes a first memory holding first information on a first amount of toner in the toner chamber and first identification information on the toner bottle. A second memory holds second information on a second amount of toner in the reservoir and second identification information on the toner bottle. If the first and second identification information do not coincide, it is determined that the toner bottle has been replaced and then the first information and the second information are updated based on the first information, the second information, and a capacity of the toner chamber.

12 Claims, 20 Drawing Sheets

IMAGE FORMING APPARATUS WITH REPLACEABLE DEVELOPER HOLDER

BACKGROUND OF THE INVENTION

1. Field of the Invention

The present invention relates to an image forming apparatus including a toner container into which a toner is replenished after the toner has been exhausted.

2. Description of the Related Art

An image forming apparatus forms a visible image developed with a toner in accordance with image information. Then, the visible image is transferred onto recording paper. A process cartridge includes a toner holding portion that holds the toner therein. As the images are formed more and more, the toner is consumed more and more.

Some image forming apparatuses are provided with a detecting means for detecting that an amount of toner remaining in the image forming apparatus is more than a reference value. The detecting means may be incorporated in a toner bottle to detect the amount of toner in the toner bottle. Alternatively, the detecting means may be incorporated in a process cartridge to detect the amount of toner in the process cartridge or a toner bottle (see Japanese Patent Application Laid-Open Nos. H09-236982 and 2003-50505).

Also, there has been proposed a technology that employs a restricting means for restricting the supply of toner from a toner bottle to a process cartridge, a memory for recording the usage of the toner in terms of the number of printed dots, and a detecting means provided in the process cartridge for detecting the remaining amount of toner. The combination of the detection output of the detecting means and the recorded usage of the toner informs a user of the time for the toner bottle to be replaced (see Japanese Patent Application Laid-Open No. 2006-267528).

However, the image forming apparatus including the detecting means disclosed by Patent Application Laid-Open No. H09-236981 suffers from a problem in that the remaining amount of the toner in the toner bottle may not be accurately detected. The image forming apparatus disclosed by Patent Application Laid-Open No. 2003-50505 suffers from a problem that incorporating the detecting means leads to increased cost of the toner bottle.

The apparatus disclosed by Patent Application Laid-Open No. H09-236982 requires a toner supply restricting means such as a shutter for restricting the supply of toner from the toner bottle into the process cartridge. The provision of a shutter involves a mechanism for opening and closing the shutter, leading to increased cost of the apparatus.

SUMMARY OF THE INVENTION

An object of the invention is to accurately detect a remaining amount of toner without using a means for restricting the supply of toner from a toner holding cartridge into a process cartridge.

An image forming apparatus is an apparatus in which a toner is replenished after the toner has been exhausted. An image forming unit includes a developer reservoir. A first controller calculates a consumed amount of developer material based on image data. A developer holder is attached to the image forming unit. The developer holder includes a developer holding chamber that holds the developer material therein and supplies the developer material into the develop reservoir. The developer holder includes a first memory that holds first information on a first amount of developer material remaining in the developer chamber and that holds first identification information on the developer holder. A second memory holds second information on a second amount of developer material remaining in the reservoir and second identification information on the developer holder. A second controller determines whether the first identification information and second identification information coincide, wherein if the first identification information and second identification information do not coincide, the second controller determines that the developer holder has been replaced and then updates the first information and the second information based on the first information, the second information, and a capacity of the developer holding chamber.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Figure 1:
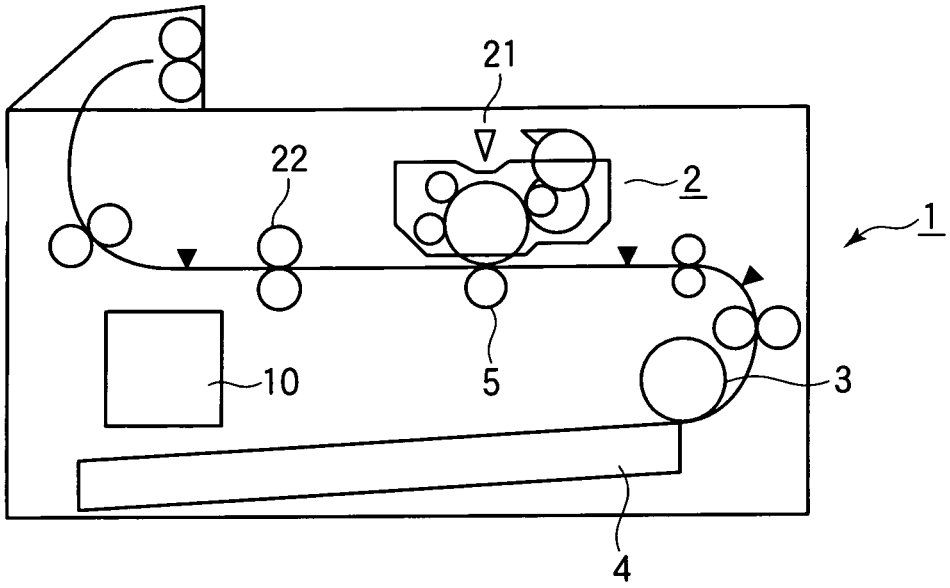
FIG. 1 illustrates the general configuration of an image forming apparatus of a first embodiment.

The embodiments of present invention will be described in detail with reference to the accompanying drawings. Elements common to the drawings have been given the same reference numerals throughout the drawings. The following embodiments will be described in terms of an electrophotographic printer, but the invention may also be applicable to image forming apparatuses that use a toner to print images. Such apparatuses include general printers, copying machines, facsimile machines, and multifunction printers (MFP).

First Embodiment

FIG. 1 illustrates the general configuration of an image forming apparatus 1 of a first embodiment. Referring to FIG. 1, the image forming apparatus 1 includes a process cartridge 2 quickly releasably attached to the image forming apparatus 1. The image forming apparatus 1 further includes an LED head 21, a feed roller 3, a paper cassette 4 that holds a stack of recording paper, a transfer roller 5, a controller 10, and a fixing roller 22.

Figure 2:
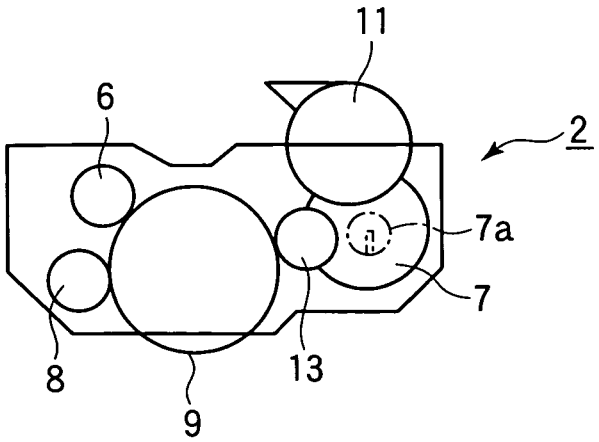
FIG. 2 illustrates the general configuration of a process cartridge.

FIG. 2 illustrates the general configuration of the process cartridge 2. Referring to FIG. 2, the process cartridge 2 includes primarily a charging roller 6, a toner reservoir 7 that holds a developer material or toner therein, a developing portion 13, a cleaning/waste toner collecting portion 8, a photoconductive drum 9, and a toner holding portion or a toner bottle 11. The charging roller 6, developing portion 13, cleaning/waste toner collecting portion 8, photoconductive drum 9 shown in FIG. 2, and the LED head and the transfer roller 5 shown in FIG. 1 constitute a print engine. The toner reservoir 7 includes a detector 7*a* that detects whether the remaining amount of toner is more than a reference value.

Figure 3:
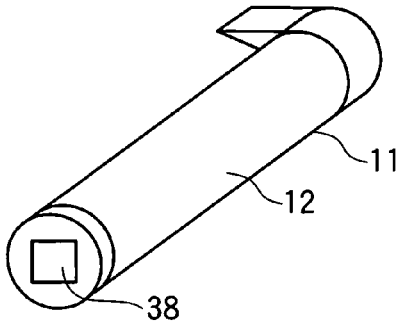
FIG. 3 is a perspective view illustrating the configuration of a toner bottle.

FIG. 3 is a perspective view illustrating the configuration of the toner bottle 11. Referring to FIG. 3, the toner bottle 11 includes a toner holding portion 12 that holds the toner therein, and a first memory or a toner tag 38 in the form of an electronic tag such as radio frequency identification (RFID).

Figure 4:
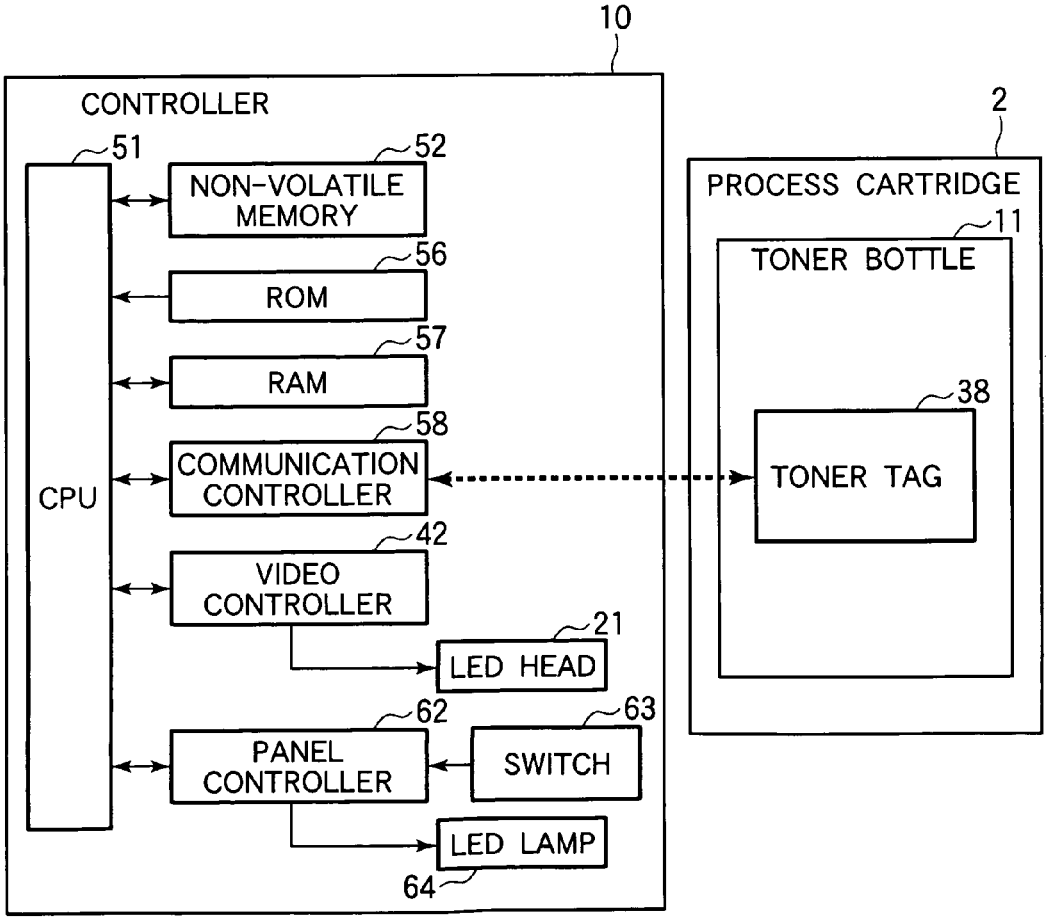
FIG. 4 is a block diagram illustrating the functional relationship between a controller and the process cartridge in the image forming apparatus.

FIG. 4 is a block diagram illustrating the functional relationship between the controller 10 and the process cartridge 2 in the image forming apparatus 1. The controller 10 includes a non-volatile memory 52 in the form of a flash memory and a CPU 51 that writes data into and reads data from the non-volatile memory 52. The controller 10 also includes a communication controller 58 that writes data into or reads data from the toner tag 38 of the toner bottle 11.

A first controller or a video controller 42 controls the operations of the LED head 21 and a transfer portion 5 which are part of the print engine. The video controller 42 also performs a function of a toner usage measuring means. More specifically, the video controller 42 counts the number of printed dots of an image and calculates the consumed amount of toner S based on the counted number of printed dots.

A second controller or a controller 10 includes a ROM 56 and a RAM 57 that store programs and various items of information, a switch 63 operated by a user, an LED lamp 64 that indicates the status of the image forming apparatus, and a panel controller 62 that controls the switch 63 and the LED lamp 64.

Figure 5:
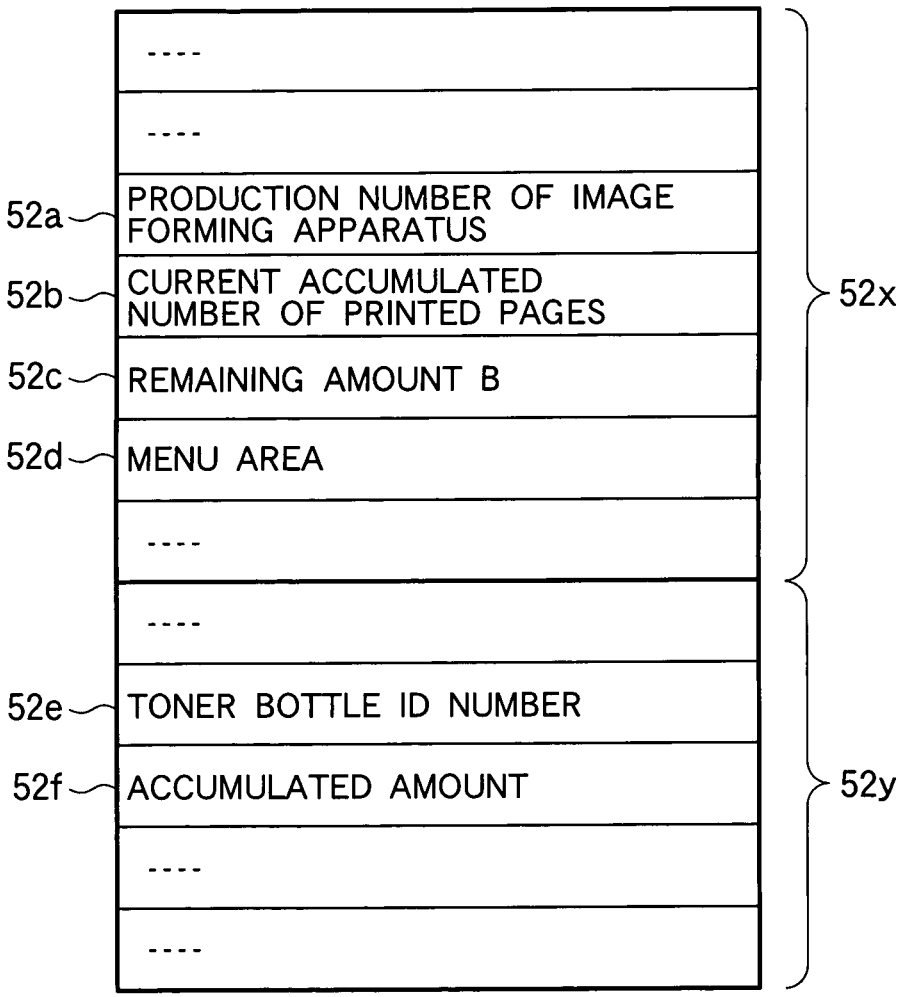
FIG. 5 illustrates an exemplary configuration of a non-volatile memory.

The CPU 51 of the controller 10 centrally controls the aforementioned circuits and portions, thereby driving the respective portions shown in FIG. 1 to perform printing on the recording paper. FIG. 5 illustrates an exemplary configuration of the non-volatile memory 52. The non-volatile memory 52 includes a memory area 52*x* that stores a variety of items of information on the operating status of the image forming apparatus 1 and a memory area 52*y* that stores a variety of items of information on the toner bottle 11 currently being used.

The memory area 52*x* holds, for example, the production number 52*a* of the image forming apparatus 1, a current accumulated number of printed pages 52*b*, and a second amount or a remaining amount of toner B (52*c*) (referred to as remaining amount B hereinafter) indicative of the amount of toner that remains in the toner reservoir 7.

The memory area 52*x* also includes a menu area 52*d* that stores various settings and selections for the image forming apparatus 1.

The memory area 52*y* includes second identification information or the toner bottle ID number 52*e* of the toner bottle 11 and an accumulated amount 52*f* of the toner consumed from when the toner bottle 11 is full of the toner.

Figure 6:
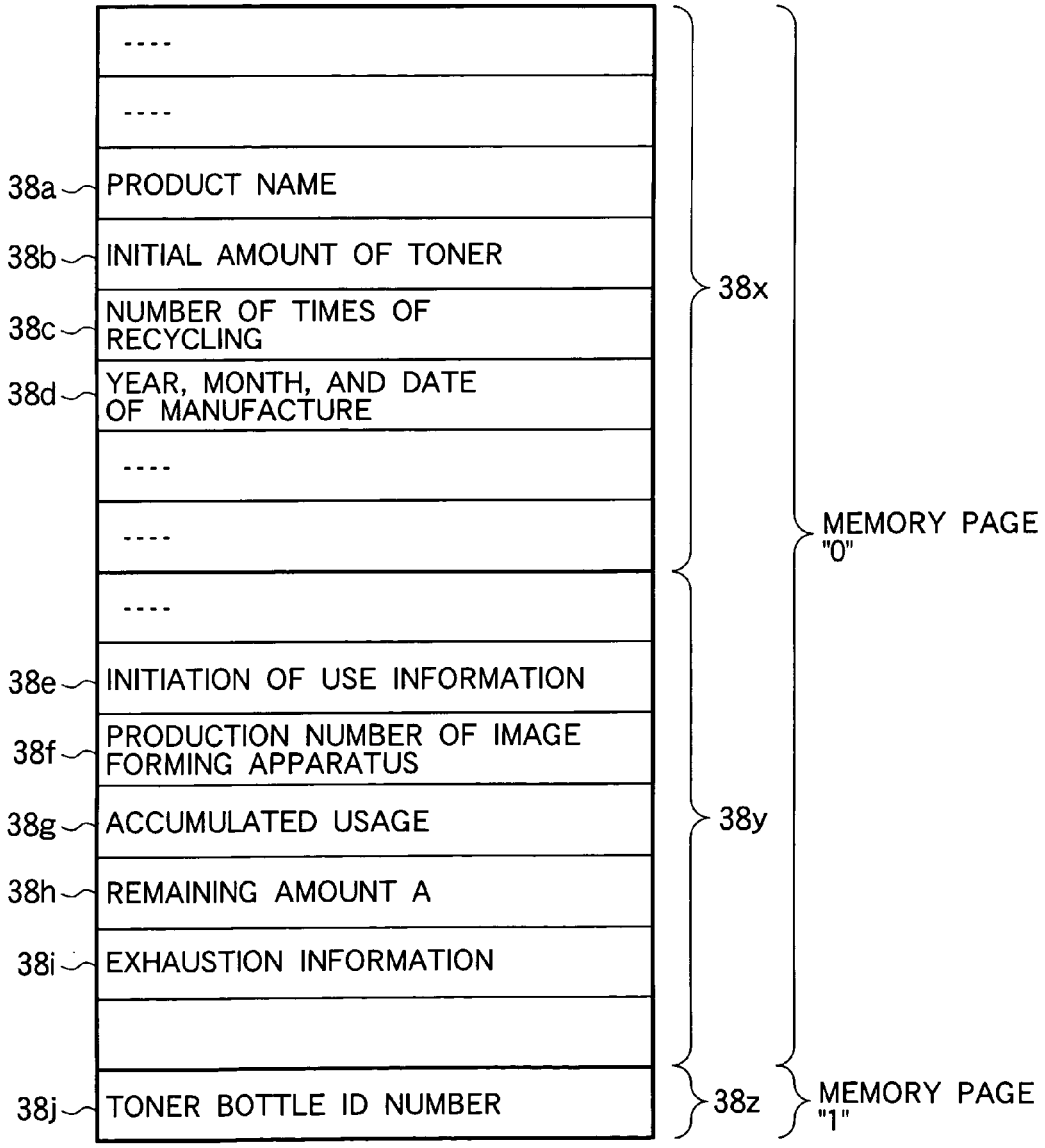
FIG. 6 illustrates an example of a toner tag of the toner bottle.

FIG. 6 illustrates an example of the toner tag 38 of the toner bottle 11. Referring to FIG. 6, the toner tag 38 includes a 180-byte memory page "0" and an 8-byte memory page "1" (from addresses 80H to 87H).

The memory page "0" includes a toner bottle specific data area 38*x* that holds a product name 38*a* of the toner bottle 11, the initial amount of toner 38*b* filled in the toner bottle 11, the number of times of recycling 38*c*, the year, month, and date of manufacture 38*d* of the toner bottle 11.

The memory page "0" also includes a memory area 38*y* used after the toner bottle 11 has been attached to the process cartridge 2. The memory area 38*y* holds beginning-of-use information 38*e*, the production number 38*f* of the image forming apparatus 1 to which the toner bottle 11 is attached, an accumulated amount of consumed toner 38*g* determined based on the print data, a first amount or a remaining amount of toner A (38*h*) (referred to as remaining amount A hereinafter) in the toner holding portion 12 of the toner bottle 11, exhaustion information 38*i* indicative that the toner in the toner bottle 11 has been exhausted.

The memory page "1" corresponds to a bottle information area 38*z* that holds first identification information or a toner bottle ID number 38*j* identifying the toner bottle 11.

{Operation of Image Forming Apparatus}

The printing operation of the image forming apparatus 1 will be described. Referring to FIG. 1, the feed roller 3 feeds the recording paper from the paper cassette 4 into a transport path. Then, the recording paper is transported to the photoconductive drum 9 located in the process cartridge 2. When the photoconductive drum 9 is rotated, the charging roller 6 charges the surface of the photoconductive drum 9. The LED head 21 illuminates the charged surface of the photoconductive drum 9 to form an electrostatic latent image on the photoconductive drum 9.

The electrostatic latent image is developed with the toner into a toner image. The toner image is then transferred onto the recording paper as the recording paper passes through a transfer point defined between the photoconductive drum 9 and the transfer roller 5. The recording paper is transported to the fixing rollers 22 after transfer. As the recording paper passes through a fixing point defined between the fixing rollers 22, the toner image is fused by pressure and heat into a permanent image before being discharged to the outside of the image forming apparatus 1.

{Operation for Detecting Remaining Amount of Toner}

The operation for detecting the remaining amount of toner will be described below in detail. When the image forming apparatus 1 is turned on or the top cover of the image forming apparatus 1 is closed, it may be assumed that the process cartridge 2 or the toner bottle 11 has been replaced by a new, unused one. Thus, a toner tag reading processing is carried out.

Figure 7:
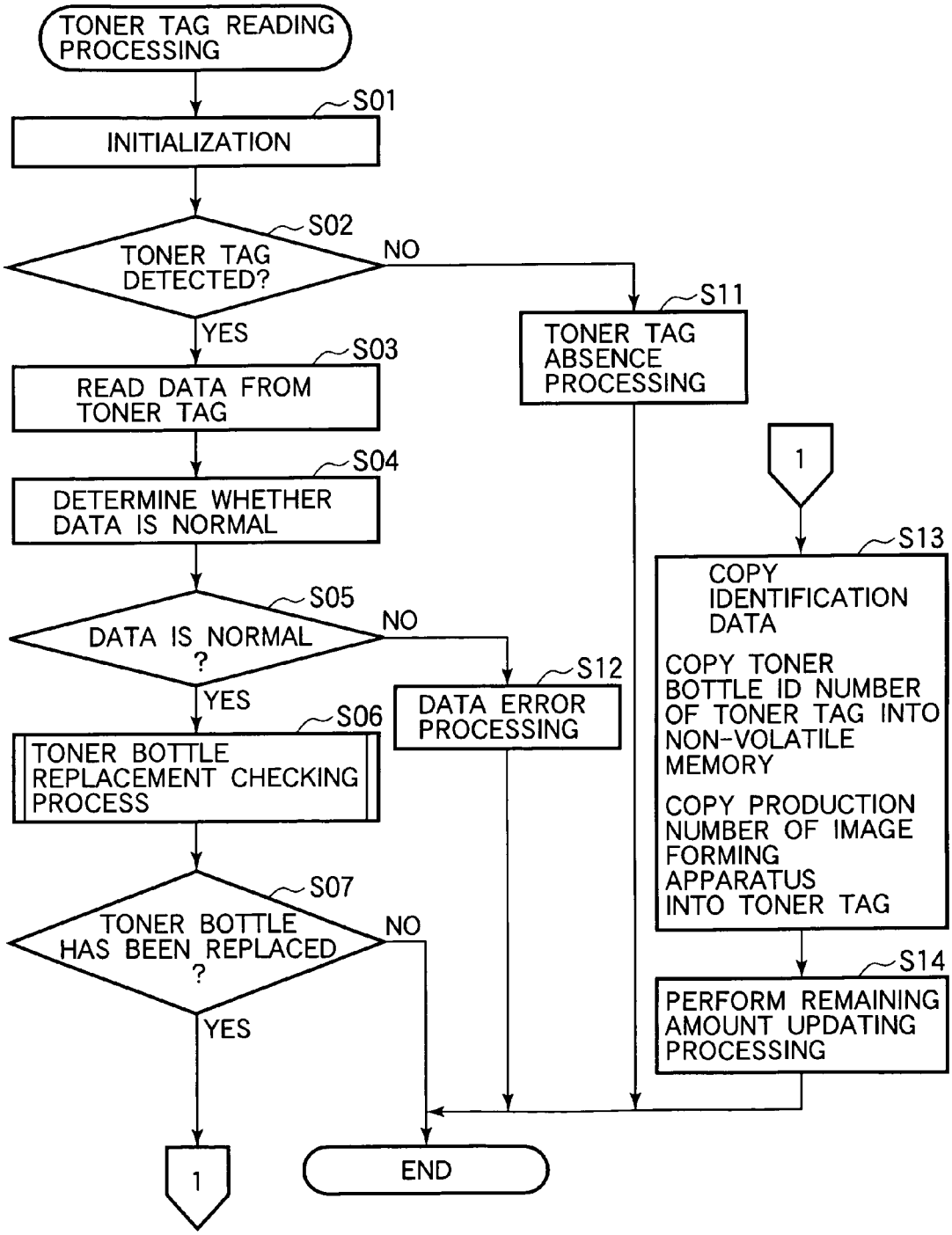
FIG. 7 illustrates a flowchart illustrating a toner tag reading processing.

FIG. 7 is a flowchart illustrating a toner tag reading processing. Initially, the toner tag reading processing of the controller 10 will be described with reference to the flowchart illustrated in FIG. 7. First, the initialization of, for example, a status register is carried out (step S01). The tag number specific to the toner bottle 11 is read from a predetermined area, thereby examining whether the toner tag 38 can be detected (step S02). If the toner tag 38 fails to be detected, it is assumed that the processor cartridge 2 or toner bottle 11 has not been attached yet, and then the program proceeds to step S11 where a toner tag absence processing is carried out.

If the toner tag 38 can be detected at step S02, the communication controller 58 of the controller 10 reads the data from the toner tag 38 (step S03).

A checksum operation, for example, is performed to determine whether the data read from the toner tag 38 is normal (step S04). If the data read from the toner tag 38 fails to be normal (NO at step S05), the program proceeds to step S12 where a data-error processing is performed.

If the data read from the toner tag 38 is normal (YES at step S05), then a toner bottle replacement checking processing is carried out (step S06). The detail of the toner bottle replacement checking processing will be described later with reference to FIG. 8.

If it is determined at step S07 that the toner bottle 11 has been replaced (YES at step S07), the program proceeds to step S13.

Then, the toner bottle ID number is copied (step S13). Specifically, the toner bottle ID number 38*j* of the toner tag 38 is copied into the toner bottle ID number 52*e* in the non-volatile memory 52. The production number 52*a* of the image forming apparatus of the non-volatile memory 52 is copied into the production number 38*f* of the toner tag 38. These items of identification data are used in the next cycle of the toner tag reading processing.

Then, a remaining amount updating processing for correcting the data read from the toner tag 38 will be carried out (step S14). The detail of the remaining amount updating processing will be described later with reference to FIG. 9.

If it is determined at step S07 that the toner bottle 11 has not been replaced yet (NO at step S07), the toner tag reading processing ends without carrying out the ID data copying processing of step S13 and the remaining amount updating processing of step S14.

{Toner Bottle Replacement Checking Processing}

Figure 8:
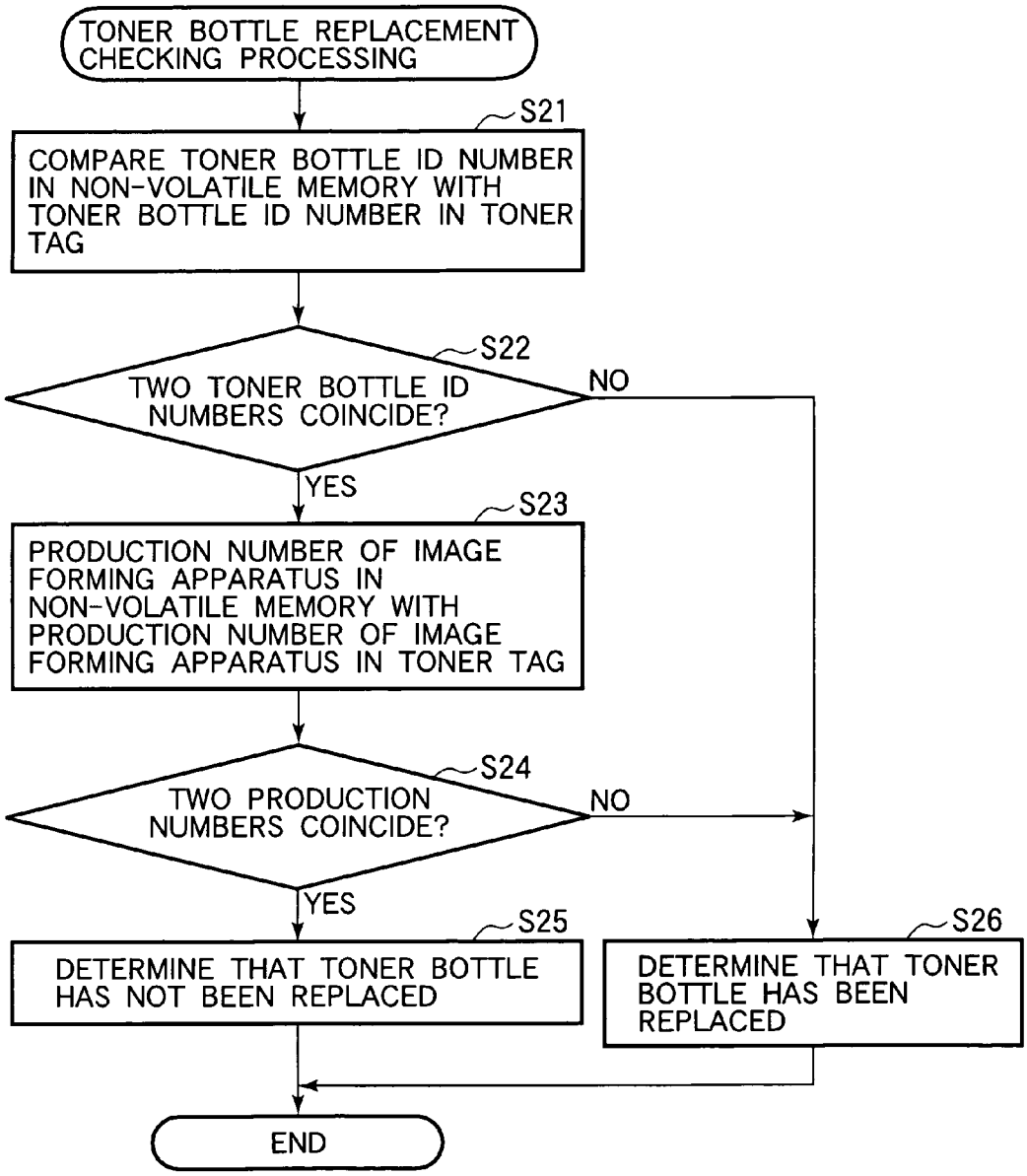
FIG. 8 is a flowchart illustrating a toner bottle replacement checking processing.

FIG. 8 is a flowchart illustrating a toner bottle replacement checking processing.

The operation of the toner bottle replacement checking processing of step S06 will be described with reference to the flowchart illustrated in FIG. 8. Initially, the toner bottle ID number 52*e* held in the non-volatile memory 52 is compared with the toner bottle ID number 38*j* held in the toner tag 38 (step S21).

If the toner bottle ID number 52*e* and the toner bottle ID number 38*j* do not coincide (NO at step S22), then it is determined that the toner bottle 11 has been replaced (step S26).

If the toner bottle ID number 52*e* and the toner bottle ID number 38*j* coincide at step S22 (YES at step S22), the controller 10 compares the production number 52*a* held in the non-volatile memory 52 with the production number 38*f* held in the toner tag 38 (step S23). If the production numbers do not coincide (NO at step S24), it is determined that the toner bottle 11 has been replaced (step S26).

If the production numbers coincide at step S24, then the program proceeds to step S25 where it is determined that the toner bottle 11 has not been replaced.

Figure 9:
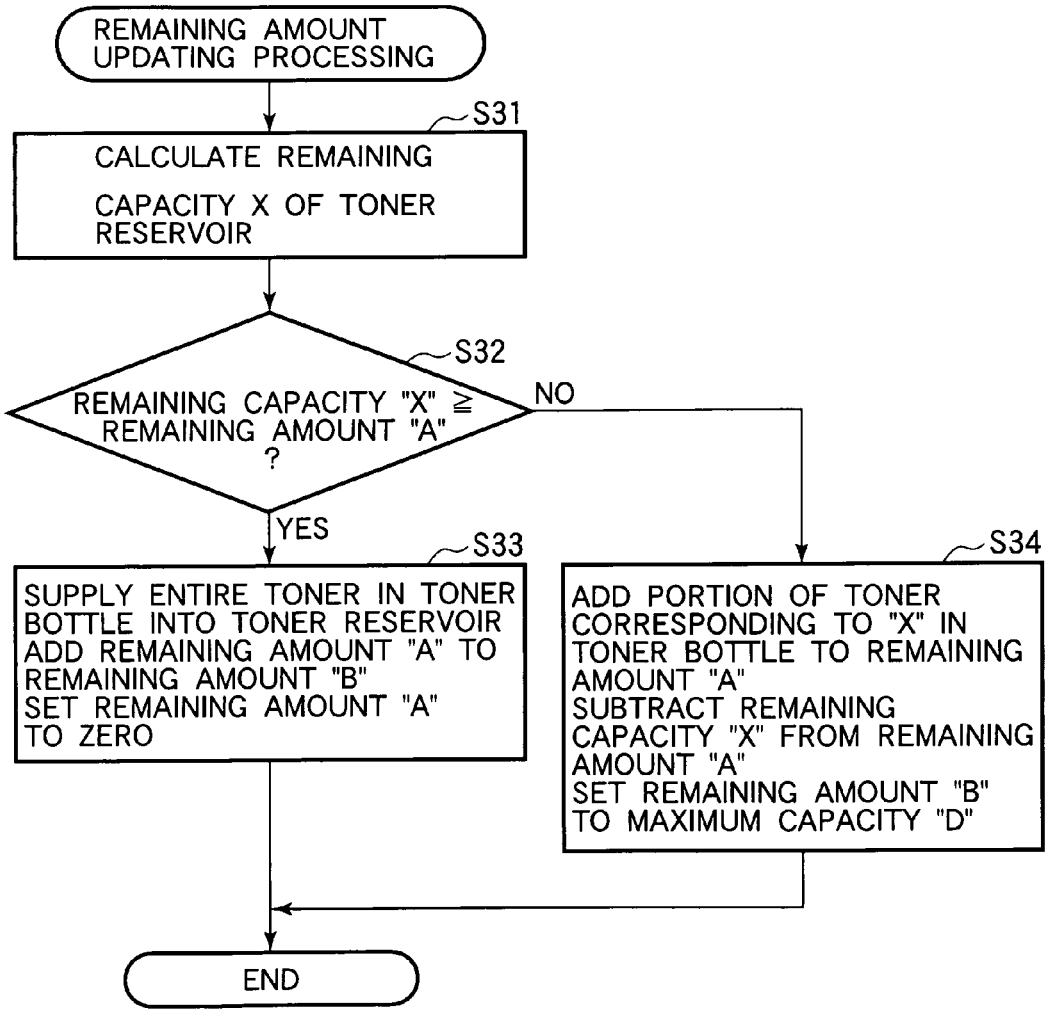
FIG. 9 is a flowchart illustrating a remaining amount updating processing.

FIG. 9 is a flowchart illustrating the remaining amount updating processing.

The operation of the remaining amount updating processing performed at step S14 will be described in detail with reference to the flowchart illustrated in FIG. 9.

The controller 10 calculates the remaining capacity X of the toner reservoir 7 (step S31). The remaining capacity X can be determined by subtracting the remaining amount B (52*c*) from the full or maximum capacity D of the toner reservoir 7. Then, the controller 10 compares the remaining capacity X with the remaining amount A (38*h*) (step S32).

Figure 10:
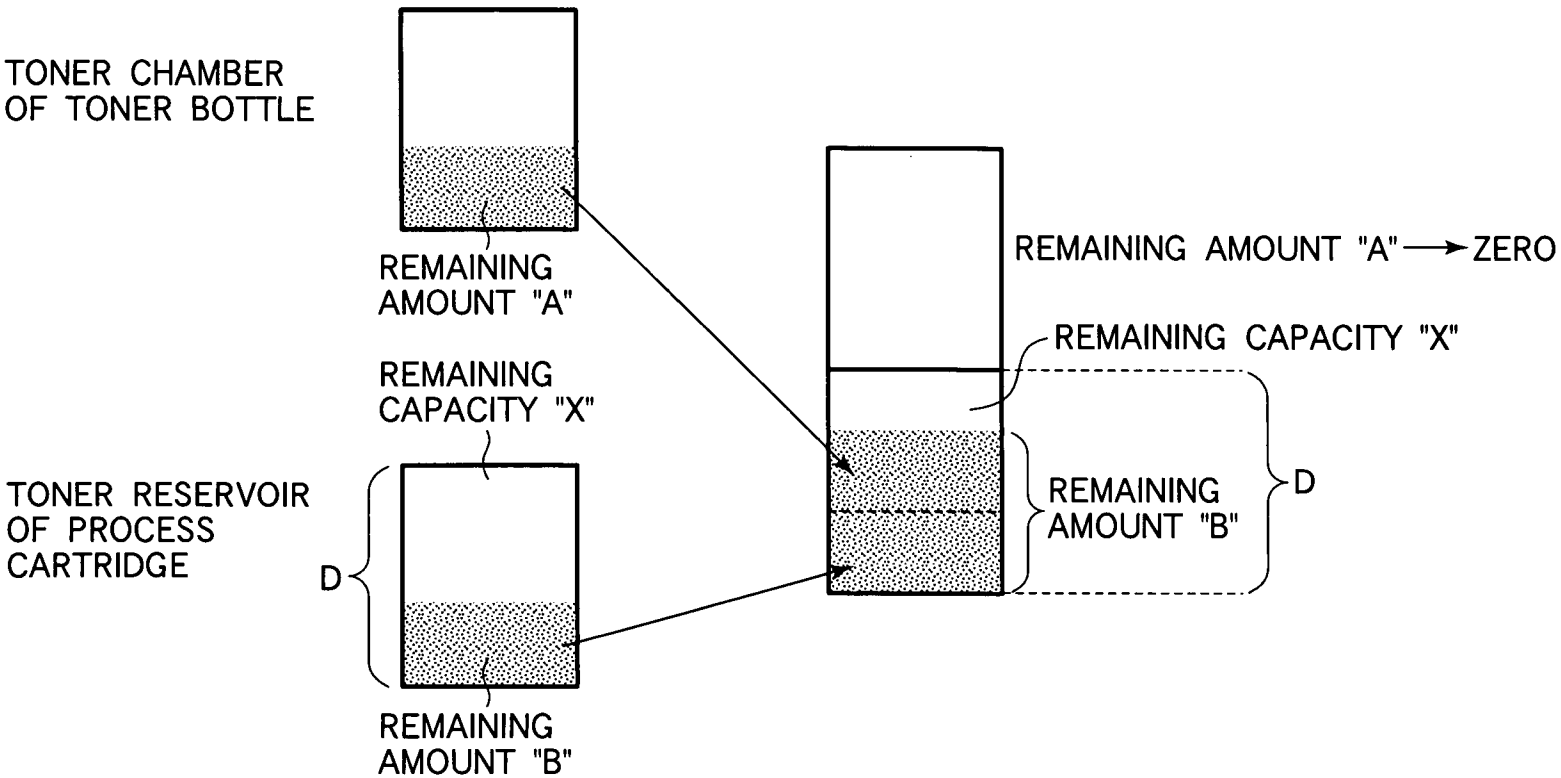
FIG. 10 illustrates the change in toner when the toner is replenished.
Figure 11:
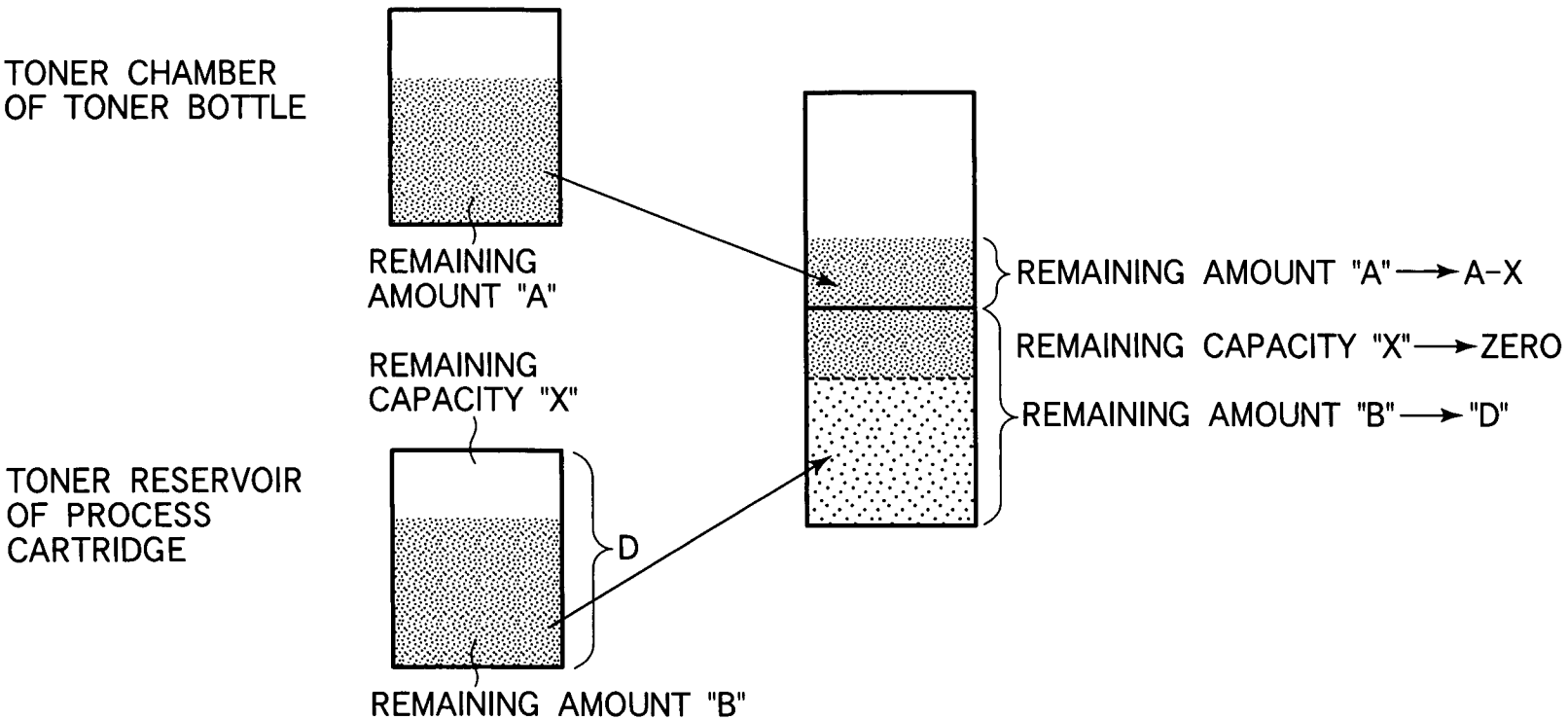
FIG. 11 illustrates the change in toner when the toner is replenished.

As illustrated in FIG. 10, if the remaining capacity X is greater than the remaining amount A (38*h*), the remaining amount A (38*h*) and the remaining amount B (52*c*) are re-calculated (step S33), assuming that the remaining capacity of the toner reservoir 7 is large enough to hold the entire toner remaining in the toner holding portion 12 of the toner bottle 11.

More specifically, the remaining amount A (38*h*) is added to the remaining amount B (52*c*), thereby obtaining a new value of the remaining amount B (52*c*). Then, the remaining amount A (38*h*) is set to "0" or zero.

As illustrated in FIG. 10, if the remaining amount A (38*h*) is greater than the remaining capacity X at step S32, then the remaining amount A (38*h*) and the remaining amount B (52*c*) are re-calculated, assuming that adding a portion of the toner held in the toner holding portion 12 to the remaining amount A (38*h*) makes the toner reservoir 7 full of the toner (step S34).

More specifically, the remaining capacity X is subtracted from the remaining amount A (38*h*), thereby obtaining a new value of the remaining amount A (38*h*). The remaining amount B (52*c*) fills the toner reservoir 7 having a maximum capacity D, i.e., i.e., the toner reservoir 7 is now full of toner.

The updating processing of the remaining amount of the toner during printing will be described with reference to the flowchart illustrated in FIG. 12. Initially, upon reception of print data, the set-up operations, (e.g., the conversion of the print data into video data to be transmitted to the video controller 42) are initiated, subsequently starting the heater and the motor (step S41).

Then, the major part of the printing is performed (step S42). This processing is performed to initiate feeding of the recording paper from the paper cassette 4 and to control the charging roller 6, video controller 42, LED head 21, developing portion 13, transfer roller 5, and fixing rollers 22 for printing.

The video controller 42 counts the number of printed dots of image data during printing, and calculates a consumed amount of toner S (step S43)

The detector 7*a* (e.g., disclosed in Japanese Patent Application Laid-Open H09-236981) of the toner reservoir 7 detects the remaining amount of toner held in the toner reservoir 7 (S44).

Then, the controller 10 performs an information on remaining toner updating processing (step S45), which will be described later with reference to FIG. 13, in which various items of information on the remaining amount B are updated and indicated to the user (step S46).

The detector 7*a* detects that the remaining amount of toner is larger than a reference value.

Then, the controller 10 makes a decision to determine whether the print data has been printed completely (step S47). If the printing has not been completed yet, the program jumps back to step S42 to continue printing. If the printing has been completed, the program proceeds to step S48 where the remaining amount updating processing is carried out. The remaining, amount updating processing is the same as step S14 of the toner tag reading processing, the detail of which is illustrated in FIG. 9.

Then, the controller 10 performs various types of processing required upon completion of printing, including notification of completion of printing, stoppage of a heater and motors, and alarming, and then completes printing (step S49).

The operation of the remaining toner updating processing performed at step S45 will be described with reference to the flowchart illustrated in FIG. 13.

Initially, the value of the remaining amount B (52*c*) is updated (step S51). Specifically, the consumed amount of toner S obtained at step S43 of FIG. 12 is subtracted from the remaining amount B (52*c*), thereby obtaining a new value of the remaining amount B (52*c*).

The output of the detector 7*a* is checked to determine whether the remaining amount of toner in the toner reservoir 7 has changed across a first reference or a predetermined level "LOW" (step S52). If the remaining amount of toner remains unchanged, then the program proceeds to step S56.

If the output of detector 7*a* indicates that the toner in the toner reservoir 7 has increased from a value smaller than the "LOW" to a value greater than "LOW" (NO at step S53), the program proceeds to step 56. If the output of detector 7*a* indicates that the amount of toner held in toner reservoir 7 has decreased from a value greater than the "LOW" to a value smaller than "LOW" (YES at step S53), the controller 10 compares the remaining amount B (52*c*) with a reference "E" (step S54).

The predetermined level "LOW" is an amount of toner remaining in the toner reservoir 7 below which print quality deteriorates. The "LOW" indicates that the toner bottle 11 should be replaced. When the "Low" is reached, the printing halts and the user is informed of the "LOW". However, if the user opens the cover and then closes it, the printing is resumed. Printing can be performed until the amount of toner in the toner reservoir 7 decreases below a second reference or a predetermined level "J" below which the remaining amount B is too small to reliably perform printing.

The reference "E" is an estimated amount of toner that is believed to actually remain in the toner reservoir 7 shortly after the detector 7*a* detects that the remaining amount of toner has decreased below "LOW". Thus, "LOW," "E," and "J," are related such that "LOW">"E">"J".

If the remaining amount B (52*c*) is equal to or smaller than the reference "E" at step S54, the program proceeds to step S56. If the remaining amount B (52*c*) is greater than the reference "E" at step S54, the remaining amount B (52*c*) is set equal to the reference "E" (step S55).

If the remaining amount of toner in the toner reservoir 7 has not changed across the predetermined level "LOW" (NO at step S52), if the output of the detector 7*a* indicates that remaining amount of toner in the toner reservoir 7 has increased across the predetermined value "LOW" (NO at step S53), or if the remaining amount B (52*c*) is equal to or smaller than the reference "E" (NO at step S54), a check is made to determine whether the output of the detector 7*a* indicates that the remaining amount A held in the toner reservoir 7 is equal to or greater than "LOW" (at step S56). Then, the remaining amount B (52*c*) is compared with the reference "E" (step S57). If the remaining amount B is equal to or greater than "E", the program ends. If the remaining amount B is smaller than "E", the remaining amount B is set equal to "E" (step S58). This is because it has been determined that the remaining amount of toner in the toner reservoir 7 is larger than "LOW" (YES at step S56), and therefore it can be assumed that the remaining amount B is at least greater than "E".

At step S56, if the remaining amount of toner is smaller than "LOW" (NO at step S56), the remaining amount B is compared with the predetermined level "J" (step S59). The predetermined level "J" is an amount of toner larger than that required for the current printing operation to be completed. When the "J" is reached, the printing halts. However, even if the user opens the cover and then closes it, the printing is not resumed.

If the remaining amount B is equal to or greater than the predetermined level "J", the program ends. If the remaining amount B is smaller than the predetermined level "J", the remaining amount B is updated with the predetermined level "J", i.e., the remaining amount B is set equal to the predetermined level "J".

The image forming apparatus of the first embodiment provides accurate detection of the remaining amount of the toner without using a restricting means for restricting the supply of the into the process cartridge 2.

Second Embodiment

Configuration

Figure 14:
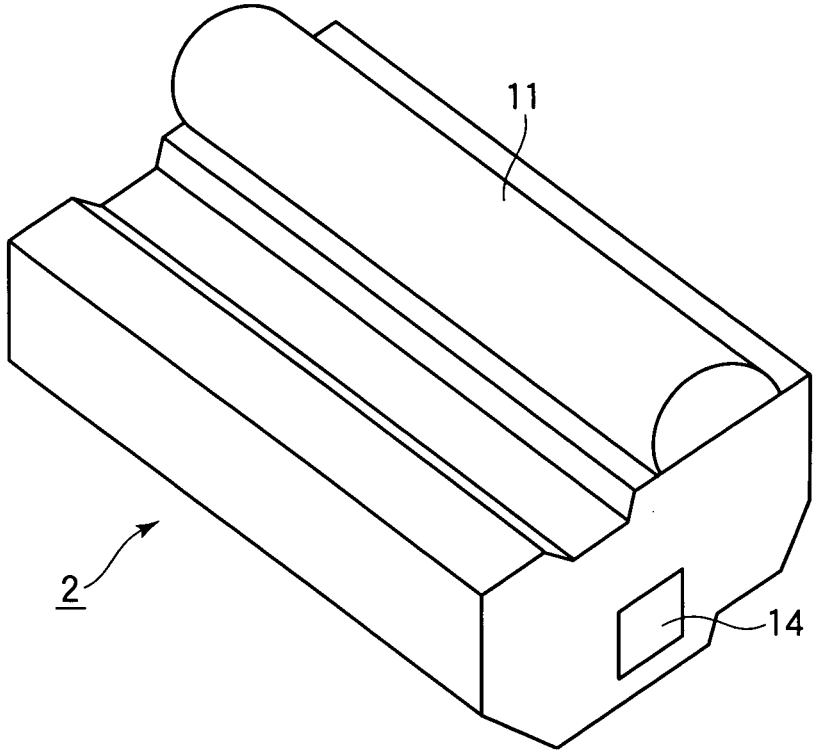
FIG. 14 is a perspective view of a process cartridge for an image forming apparatus of a second embodiment.
Figure 15:
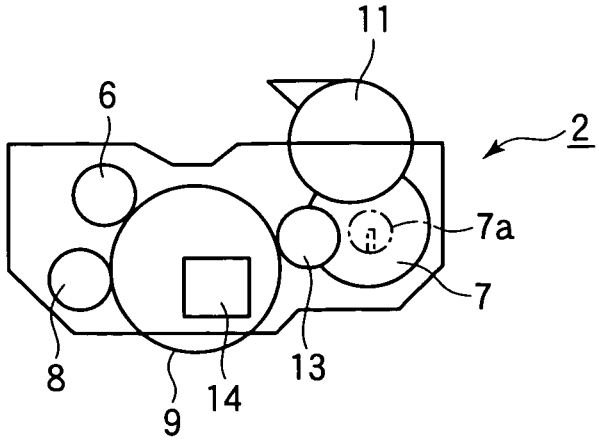
FIG. 15 is a cross-sectional view of a process cartridge of the second embodiment.
Figure 16:
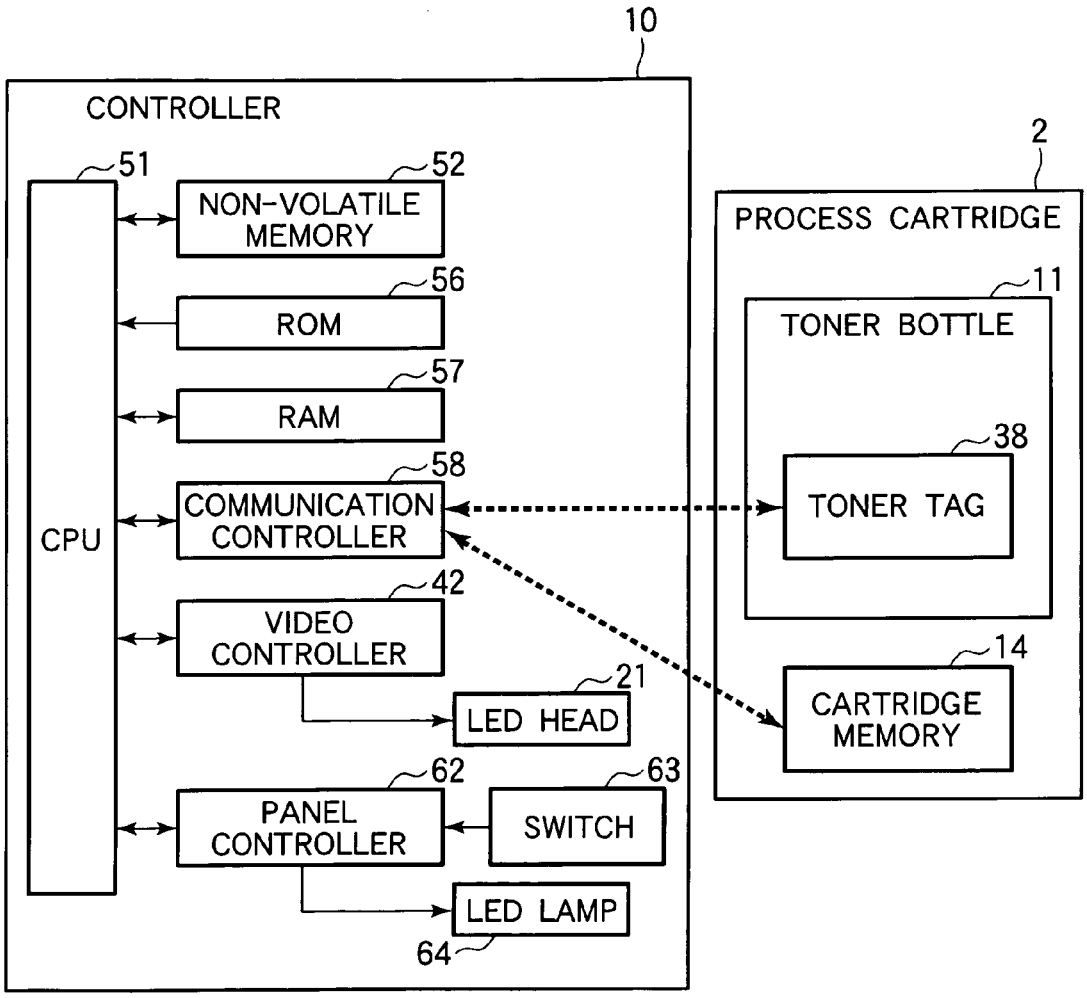
FIG. 16 is a block diagram illustrating a controller and the process cartridge.

FIG. 14 is a perspective view of a process cartridge 2 for an image forming apparatus of a second embodiment. FIG. 15 is a cross-sectional view of the process cartridge 2. FIG. 16 is a block diagram illustrating a controller 10 and the process cartridge 2.

Referring to FIGS. 14-16, the process cartridge 2 includes a third memory or a cartridge memory 14 which is a non-volatile memory in the form of an electronic tag. The controller 10 includes a communication controller 58 via which data is communicated between a toner tag 38 and the cartridge memory 14. The remaining configuration is the same as that of the first embodiment and its detailed description is omitted.

Figure 17:
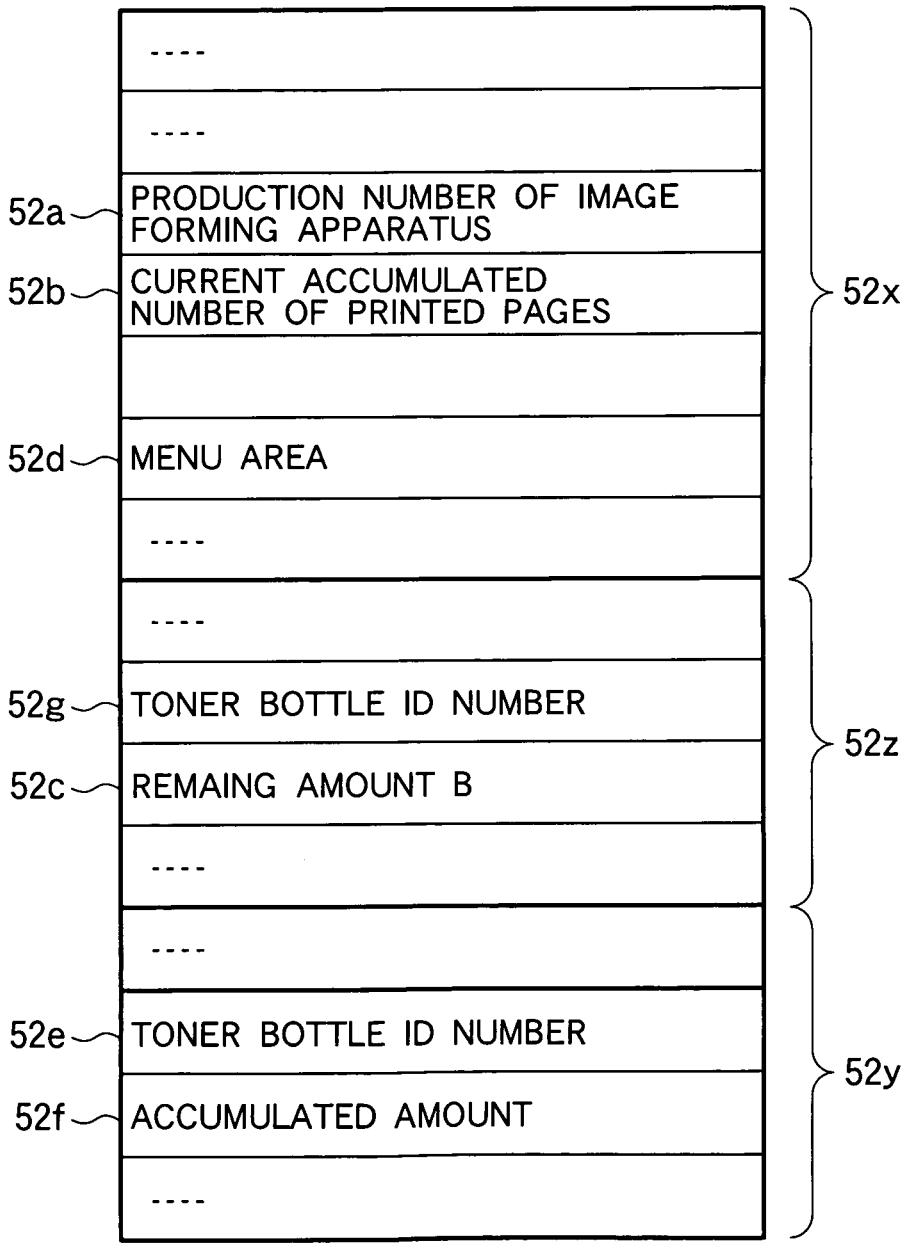
FIG. 17 illustrates an example of the configuration of a non-volatile memory of the second embodiment.

FIG. 17 illustrates an example of the configuration of the non-volatile memory 52 of the second embodiment. Referring to FIG. 17, the non-volatile memory 52 has a memory capacity of about 128 bytes. The non-volatile memory 52 includes a memory area 52*x* that holds various items of information on the status of the image forming apparatus 1, a memory area 52*y* that holds various items of information on the toner bottle 11 currently being used, and a memory area 52*z* that holds information on the process cartridge 2 currently being used.

The memory area 52*x* holds sixth identification information or the production number 52*a* of the image forming apparatus 1, a current accumulated number of printed pages 52*b*, the remaining amount B (52*c*) (referred to as remaining amount B hereinafter) indicative of the amount of toner that remains in the toner reservoir 7, and a menu area 52*d* that holds various settings and selections for the image forming apparatus 1.

The memory area 52*z* holds an ID number 52*g* of the process cartridge 2 and a value of the remaining amount B (52*c*).

The memory area 52*y* includes an ID number 52*e* of the toner bottle 11, and an accumulated amount 52*f* of the toner consumed from when the toner bottle 11 is full of the toner.

Figure 18:
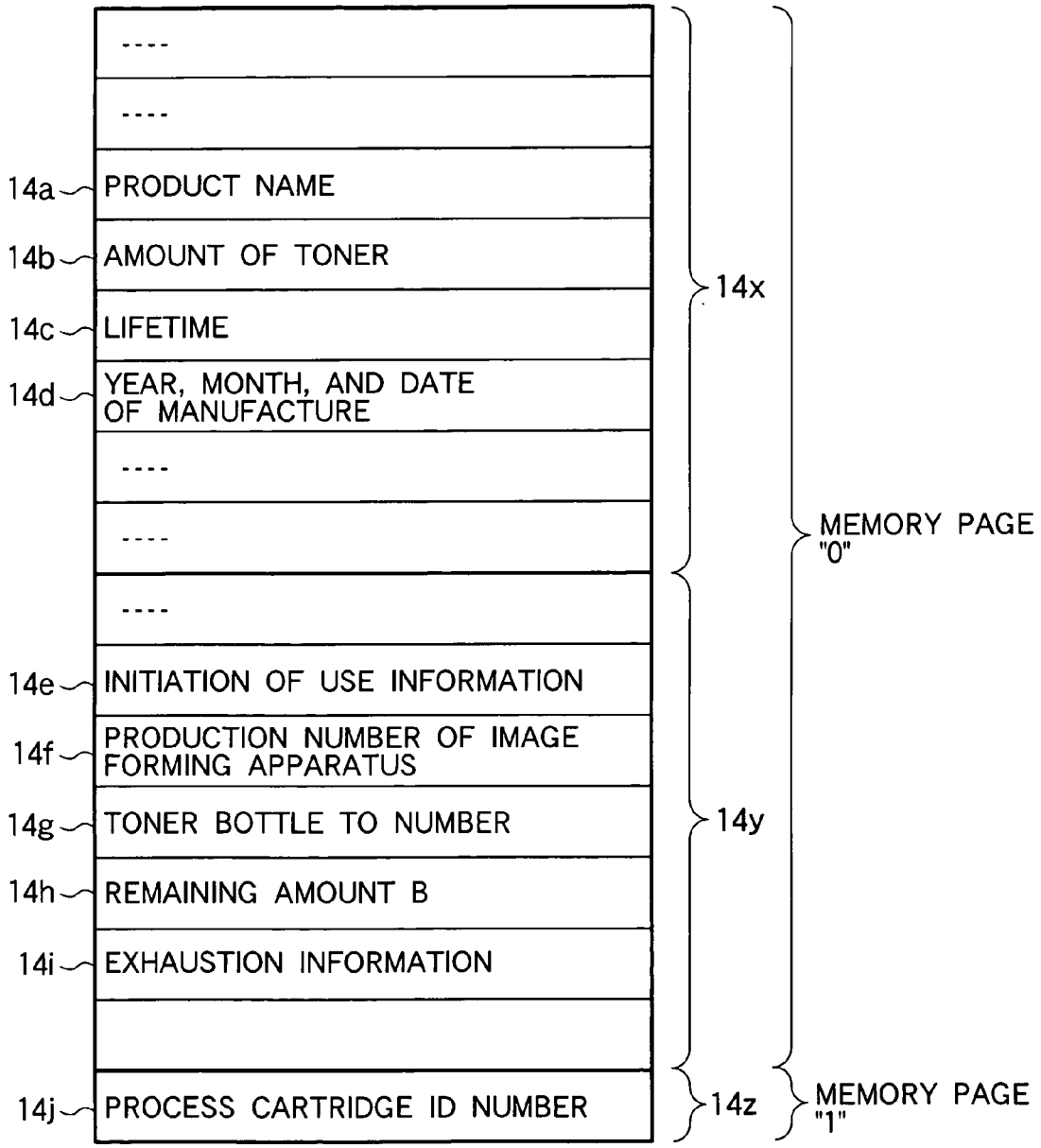
FIG. 18 illustrates an example of a cartridge memory in the process cartridge.

FIG. 18 illustrates an example of the cartridge memory 14 in the process cartridge 2. The cartridge memory 14 includes a memory page "0" having a capacity of 128 bytes and a memory page "1" having a capacity of 8 bytes, i.e., from addresses 80H to 87H.

The memory page "0" includes a memory area 14*x* that holds data unique to the process cartridge 2, and a memory area 14*y* that holds the status of the process cartridge 2 when the process cartridge 2 is being used.

The memory area 14*x* holds the product name 14*a*, a toner holding capacity 14*b*, the lifetime 14*c* of the process cartridge 2, the year, month, and date of manufacture 14*d* of the process cartridge 2, which are data unique to the process cartridge 2 and are written before shipment of the process cartridge 2. The lifetime 14*c* indicates that the process cartridge has become empty of toner.

The memory area 14*y* holds initiation of use information 14*e*, the production number 14*f* of the image forming apparatus 1, the consumed amount of toner S 14*g* determined based on the print data, the remaining amount B (14*h*) in a toner holding portion 12 of the process cartridge 2, and exhaustion information 14*i* indicative that the toner in the process cartridge 2 has been exhausted.

The memory page "1" corresponds to a bottle information area 14*z* that holds a third identification information or a process cartridge ID number 14*j* identifying the process cartridge 2.

Figure 19:
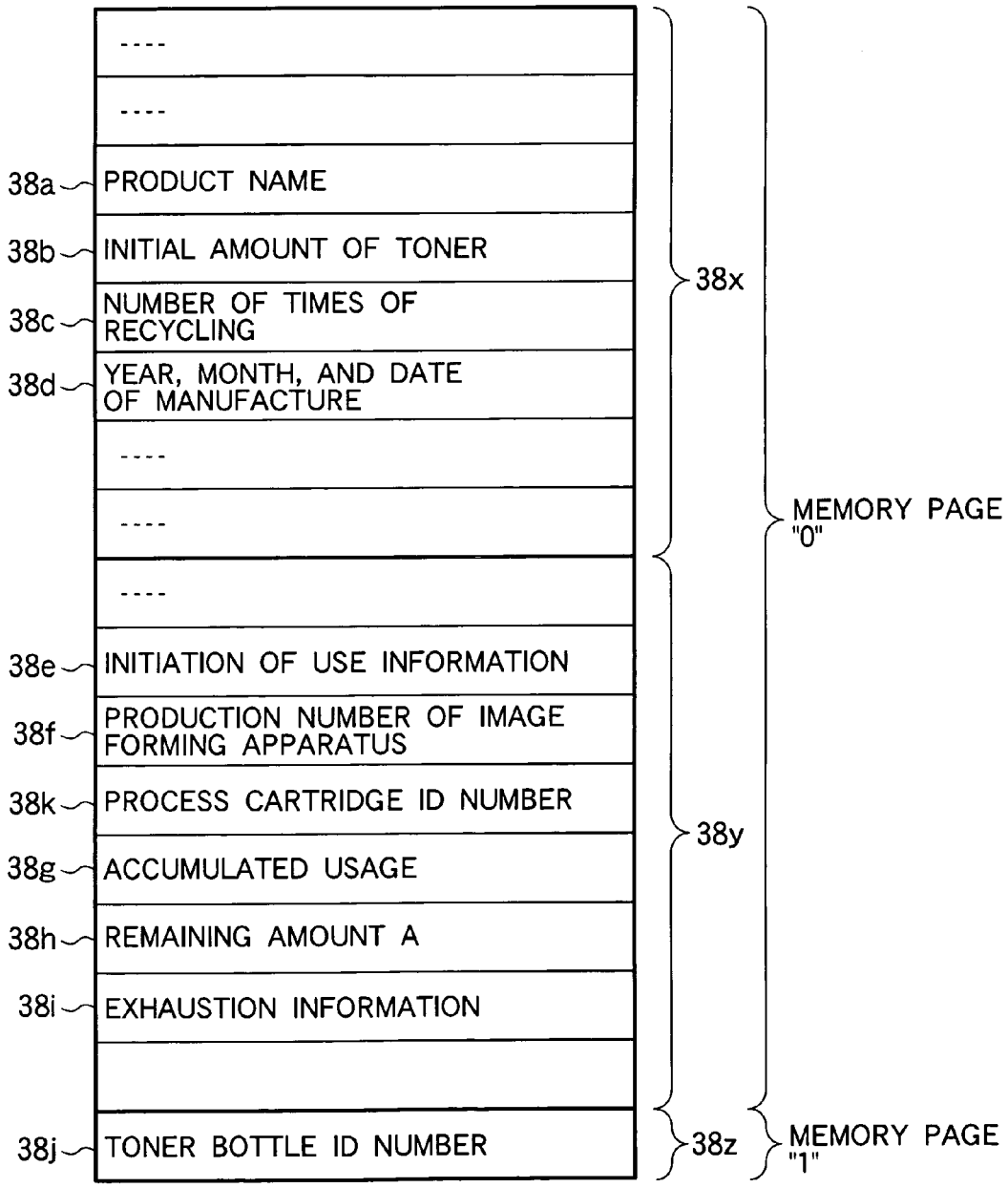
FIG. 19 illustrates an example of a toner tag of the toner bottle.

FIG. 19 illustrates an example of the toner tag 38 of the toner bottle 11. Referring to FIG. 6, the toner tag 38 includes a 180-byte memory page "0" and an 8-byte memory page "1" (from addresses 80H to 87H).

The memory page "0" includes, for example, a toner bottle specific data area 38*x* that holds a product name 38*a* unique to the toner bottle 11, the initial amount 38*b* of toner in the toner bottle 11, the number of times of recycling 38*c*, the year, month, and date of manufacture 38*d* of the toner bottle 11. The toner bottle 11 having the aforementioned toner bottle specific data is supplied to the users.

The memory page "0" includes a memory area 38*y* used after the toner bottle 11 has been attached to the process cartridge 2. The memory area 38*y* holds the beginning-of-use information 38*e*, fifth identification information or the production number 38*f* of the image forming apparatus 1, fourth identification information or an ID number 38*k* of the process cartridge 2, an accumulated usage 38*g* determined based on the print data, the remaining amount of toner A (38*h*) (referred to as remaining amount A hereinafter) in the toner holding portion 12 of the toner bottle 11, and exhaustion information 38*i* indicative that the toner in the toner bottle 11 has been exhausted.

The memory page "1" corresponds to bottle information area 38*z* that holds a toner bottle ID number 38*j* identifying the toner bottle 11.

{Operation for Detecting Remaining Amount of Toner}

The image forming apparatus 1 of the aforementioned configuration operates as follows: The printing operation of the apparatus in general is the same as that of the first embodiment, and therefore its detailed description is omitted.

The operation for detecting the remaining amount of toner will be described below in detail. When the image forming apparatus 1 is turned on or when the top cover of the image forming apparatus 1 is closed, it may be assumed that the process cartridge 2 or the toner bottle 11 has been replaced by a new, unused one. Thus, a toner tag reading process and an cartridge memory reading process for reading information from the cartridge memory are carried out.

Figure 20:
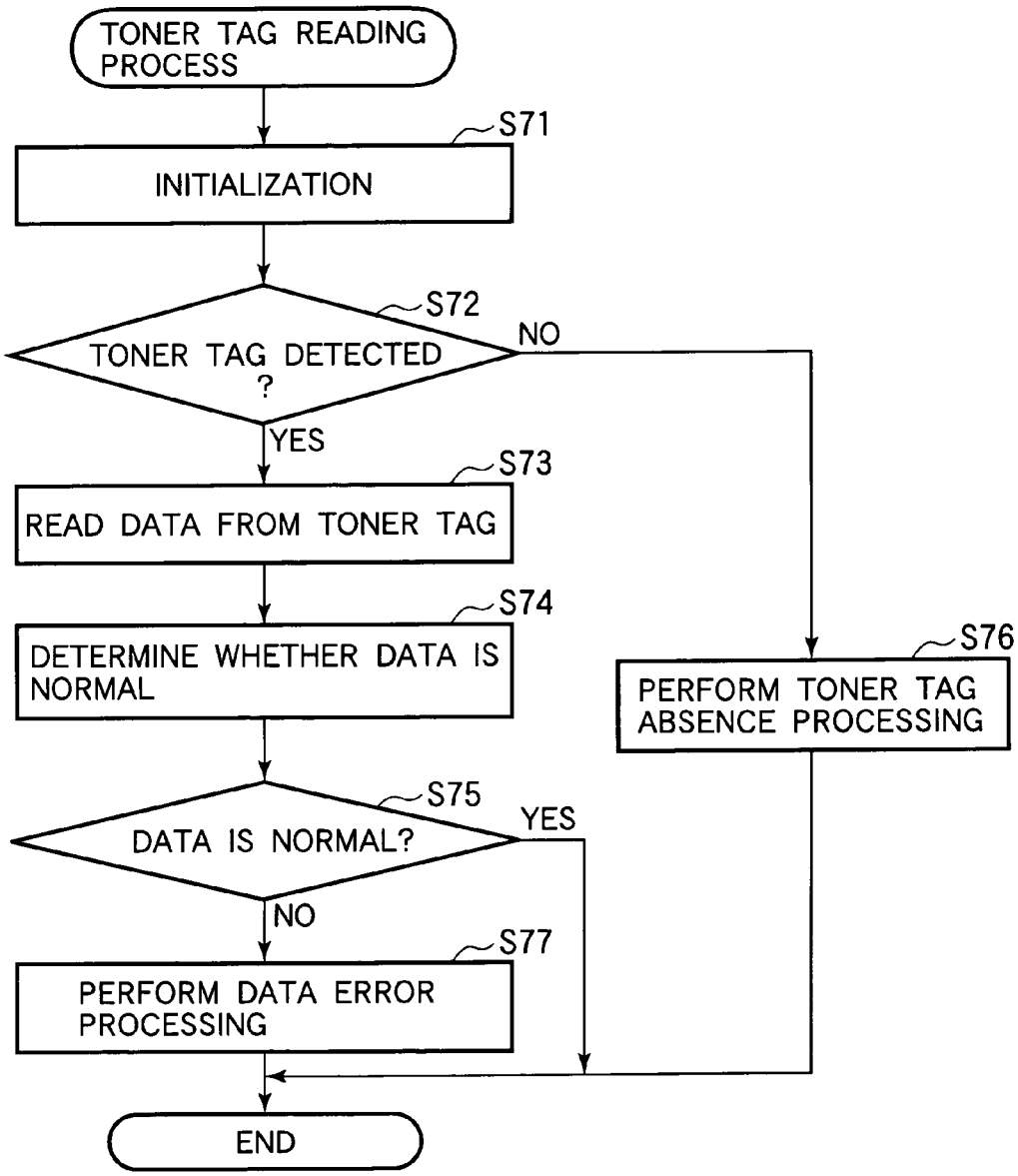
FIG. 20 is a flowchart illustrating a toner tag reading processing.

FIG. 20 is a flowchart illustrating the toner tag reading processing.

Initially, the toner tag reading processing performed by the controller 10 will be described with reference to the flowchart illustrated in FIG. 20.

First, the initialization of, for example, a status register is carried out (step S71). The tag number is read from a predetermined area, thereby examining whether the toner tag 38 can be detected normally (step S72). If the toner tag 38 fails to be detected, it is assumed that the toner bottle 11 has not been attached yet, and the program proceeds to step S76 where a toner tag absence processing is carried out.

If the toner tag 38 can be detected at step S72, the communication controller 58 of the controller 10 reads the data from the toner tag 38 (step S73). A checksum operation, for example, is performed to determine whether the data read from the toner tag 38 is normal (steps S74 and S75). If the data read from the toner tag 38 fails to be normal (NO at step S75), the program proceeds to step S77 where a data-error processing is performed.

If the data read from the toner tag 38 is normal (YES at step S75), then the program ends.

Figure 21:
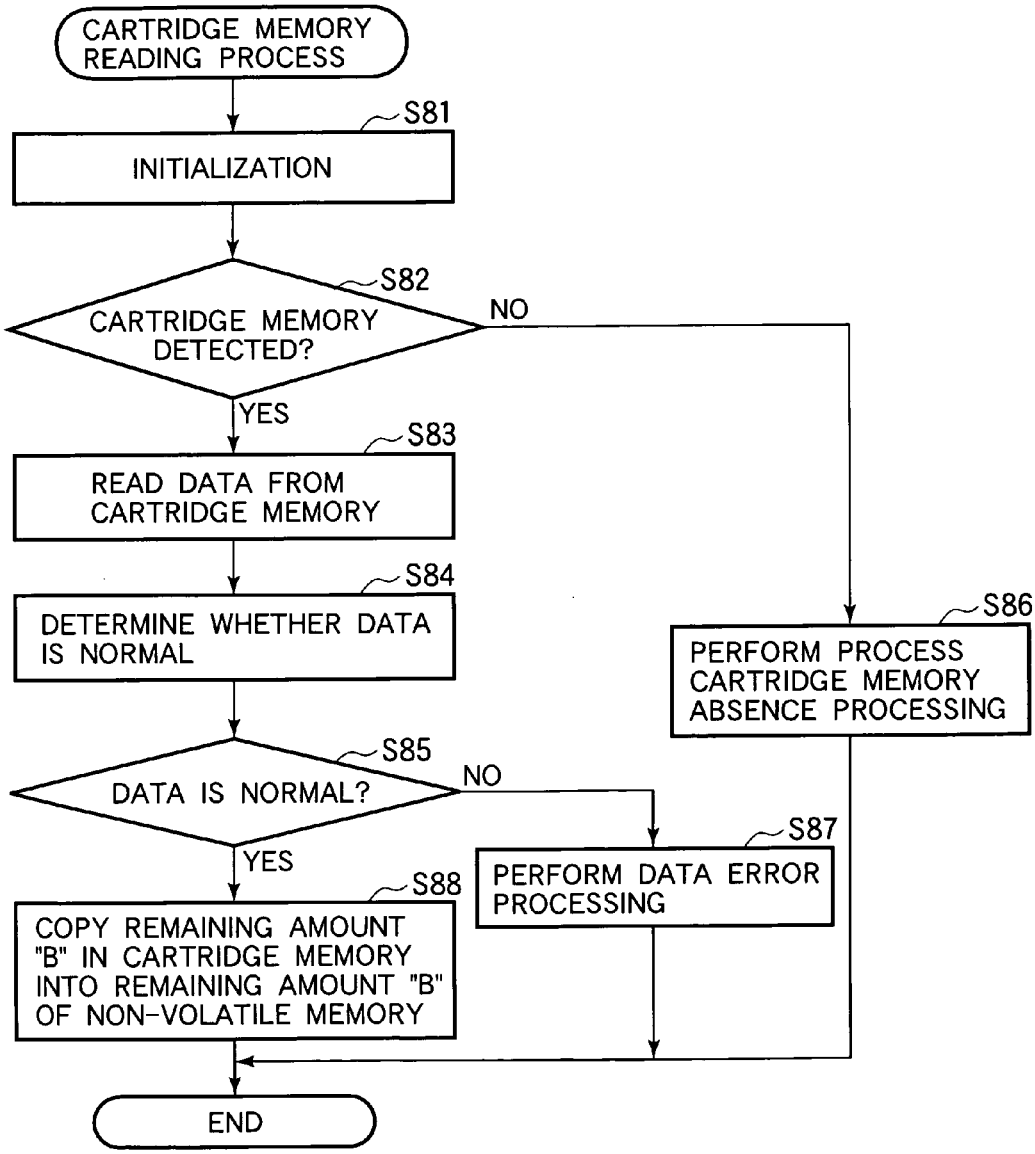
FIG. 21 is a flowchart illustrating an information reading processing.

FIG. 21 is a flowchart illustrating the information reading processing.

The cartridge memory reading processing for reading information from the cartridge memory will be described with, reference to FIG. 21. First, the initialization of, for example, a status register is carried out (step S81).

The cartridge number is read from a predetermined area, and then the cartridge number is checked to determine whether the cartridge memory 14 is normally detected (step S82). If the cartridge memory 14 fails to be detected, it is assumed that the process cartridge 2 has not been attached yet or does not have a cartridge memory. Then, the program proceeds to step S86 where a process cartridge memory absence processing is carried out.

If the cartridge number is detected at step S82, then the controller 10 reads the data from the cartridge memory 14 (step S83). A checksum operation, for example, is performed to determine whether the data read from the cartridge memory 14 is normal (step S84).

If the data read from the cartridge memory 14 is not detected properly (NO at step S85), then the program performs a data-error processing in which the abnormal condition is indicated to the user by means of, for example, an LED lamp 64 of a panel display 62 (step S87).

If the data read from the cartridge memory 14 is detected properly (YES at step S85), then the remaining amount B (14*h*) held in the cartridge memory 14 is copied into the remaining amount B (52*c*) (step S88), and then the program ends.

When the image forming apparatus 1 is turned on or when the top cover is closed, a consumable memory reading processing is carried out to read the data from consumables memories, i.e., the toner tag 38, cartridge memory 14, and non-volatile memory 52. The consumable memory reading processing will be described with reference to the flowchart illustrated in FIG. 22.

Figure 22:
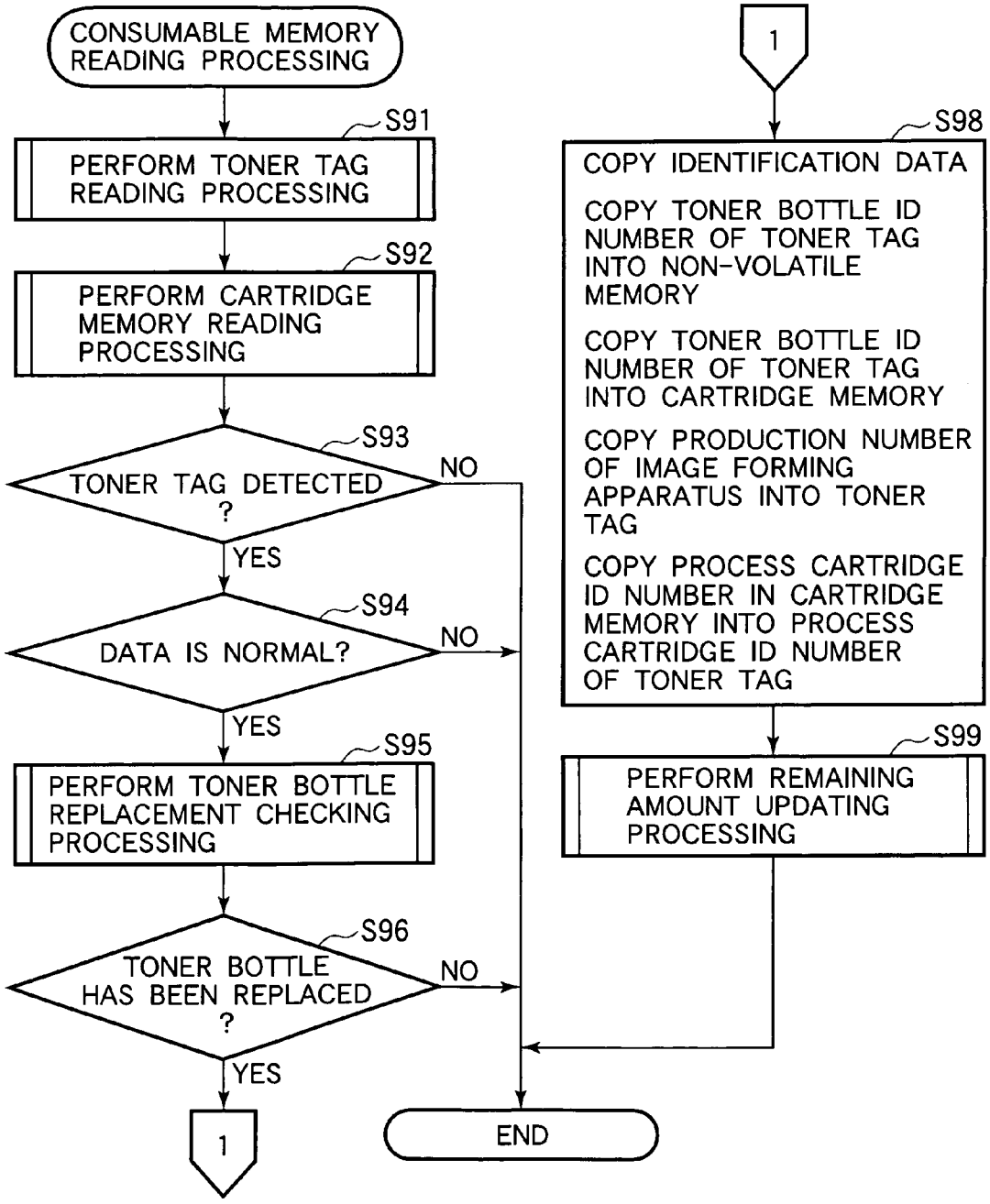
FIG. 22 is a flowchart illustrating a consumable memory reading processing.

FIG. 22 is a flowchart illustrating the consumable memory reading processing.

Initially, the toner tag reading processing described with reference to FIG. 20 is carried out (step S91). Then, the cartridge memory reading processing is carried out (step S92).

Then, a check is made to determine whether the toner tag 38 can be detected normally (step S93). This step is essentially the same as step S72 in FIG. 20. If the toner tag 38 is not found to be normal, the consumable memory reading processing ends.

If the toner tag 38 is found to be detected (YES at step S93), a check is made to determine whether the data read from the toner tag 38 is normal (step S94). This step is essentially the same as step S75 in FIG. 20.

If the data read from the toner tag 38 is not found to be normal (NO at step S94), the consumable memory reading processing ends. If the data read from the toner tag 38 is found to be normal, the program proceeds to step S95 where a toner bottle replacement checking processing is performed. This processing will be described in detail with reference to FIG. 23.

Then, a check is made to determine whether the toner bottle 11 has been replaced (step S96). This step is carried out by checking the result of the toner bottle replacement checking processing. If the toner bottle 11 has not been replaced yet, the consumable memory reading processing ends.

If the toner bottle 11 has been replaced, the identification data 38*j* and 52*a* is copied from the toner tag 38 (step S98). More specifically, the toner bottle ID number 38*j* of the toner tag 38 is copied into the toner bottle ID number 52*e* of the non-volatile memory 52, and the production number 52*a* held in the image forming apparatus 1 of the non-volatile memory 52 is copied into the toner tag 38.

Also, if the cartridge memory 14 is detected properly, the toner bottle ID number 38*j* held in the toner tag 38 is copied into the toner bottle ID number 14*g* of the cartridge memory 14, and the process cartridge ID number 14*j* held in the cartridge memory 14 is copied into the process cartridge ID number 38*k* of the toner tag 38. These identification data are used in the next toner tag reading processing.

Then, a remaining amount updating processing described with reference to FIG. 9 in the first embodiment is carried out (step S99). In the remaining amount updating processing of the second embodiment, if the cartridge memory 14 is detected properly, the remaining amount B (14*h*) held in the cartridge memory 14 is also updated.

Then, the toner bottle replacement checking processing carried out at step S95 will be described with reference to the flowchart illustrated in FIG. 23.

Figure 23:
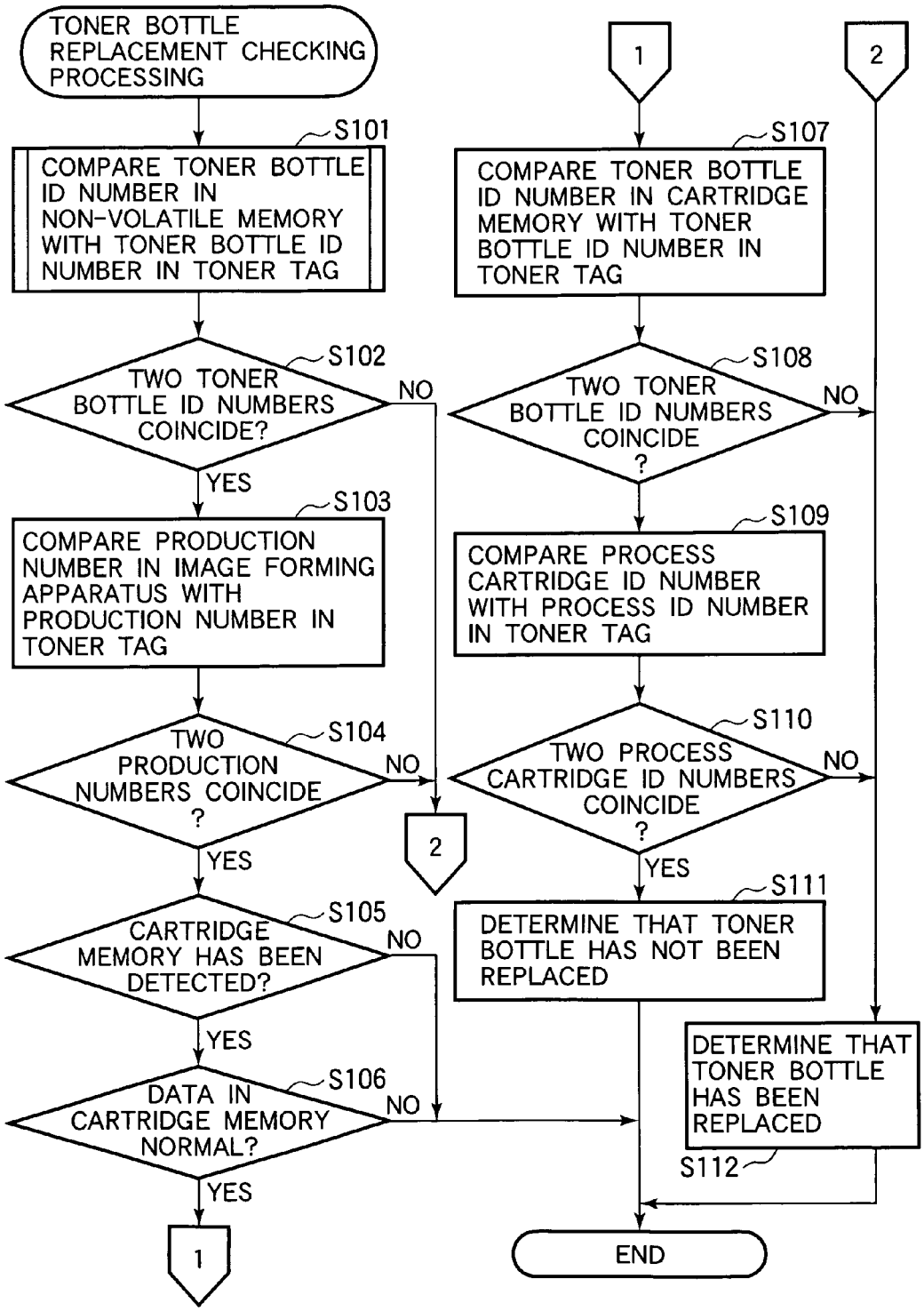
FIG. 23 is a flowchart illustrating the toner bottle replacement checking processing.

FIG. 23 is a flowchart illustrating the toner bottle replacement checking processing.

The controller 10 compares the toner bottle ID number 52*e* held in the non-volatile memory 52 with the toner bottle ID number 38*j* held in the toner tag 38 (step S101).

If the toner bottle ID number 52*e* and the toner bottle ID number 38*j* do not coincide at step S102, the program proceeds to step S112 where it is determined that the toner bottle 11 has been replaced (step S102).

If the toner bottle ID number 52*e* and the toner bottle ID number 38*j* do not coincide, then the production number 52*a* of the image forming apparatus is compared with the production number 38*f* of the toner tag 38 (step S103).

If the production number 52*a* of the image forming apparatus 1 and the production number 38*f* of the toner tag 38 do not coincide (NO at step S104), the program proceeds to step S112 where it is determined that the toner bottle 11 has been replaced.

If the production number 52*a* of the image forming apparatus and the production number 38*f* of the toner tag 38 coincide (YES at step S104), a check is made to determine whether the cartridge memory 14 has been detected (step S105). Step S105 is the same as step S82 shown in FIG. 21.

If the cartridge memory 14 has not been detected (NO at step S105), it is determined the toner bottle 11 has not been replaced (step S111).

If the cartridge memory 14 has been detected (YES at step S105), a check is made to determine whether the data of the cartridge memory 14 is normal (step S106). Step 106 is the same as step S85 illustrated in FIG. 21.

If the cartridge memory 14 has been detected properly (NO at step S106), it is determined that the toner bottle 11 has not been replaced (step S111).

If the cartridge memory 14 has been detected properly (YES at step S106), the toner bottle ID number 14*g* of the cartridge memory 14 is compared with the toner bottle ID number 38*j* held in the toner tag 38 (step S107, S108).

If the toner bottle ID number 14*g* and the toner bottle ID number 38*j* do not coincide (NO at step S108), the program proceeds to step S112 where it is determined that the toner bottle 11 has been replaced (step S108).

If the toner bottle ID number 14*g* and the toner bottle ID number 38*j* coincide (YES at step S108), the process cartridge ID number 14*j* held in the cartridge memory 14 is compared with the process cartridge ID number 38*k* of the toner tag 38 (step S109).

If the process cartridge ID number 14*j* and the process cartridge ID number 38*k* do not coincide (NO at step S110), the program proceeds to step S112 where it is determined that the toner bottle 11 has been replaced.

If the process cartridge ID number 14*j* and the process cartridge ID number 38*k* coincide (YES at step S110), it is determined that the toner bottle 11 has not been replaced.

Figure 12:
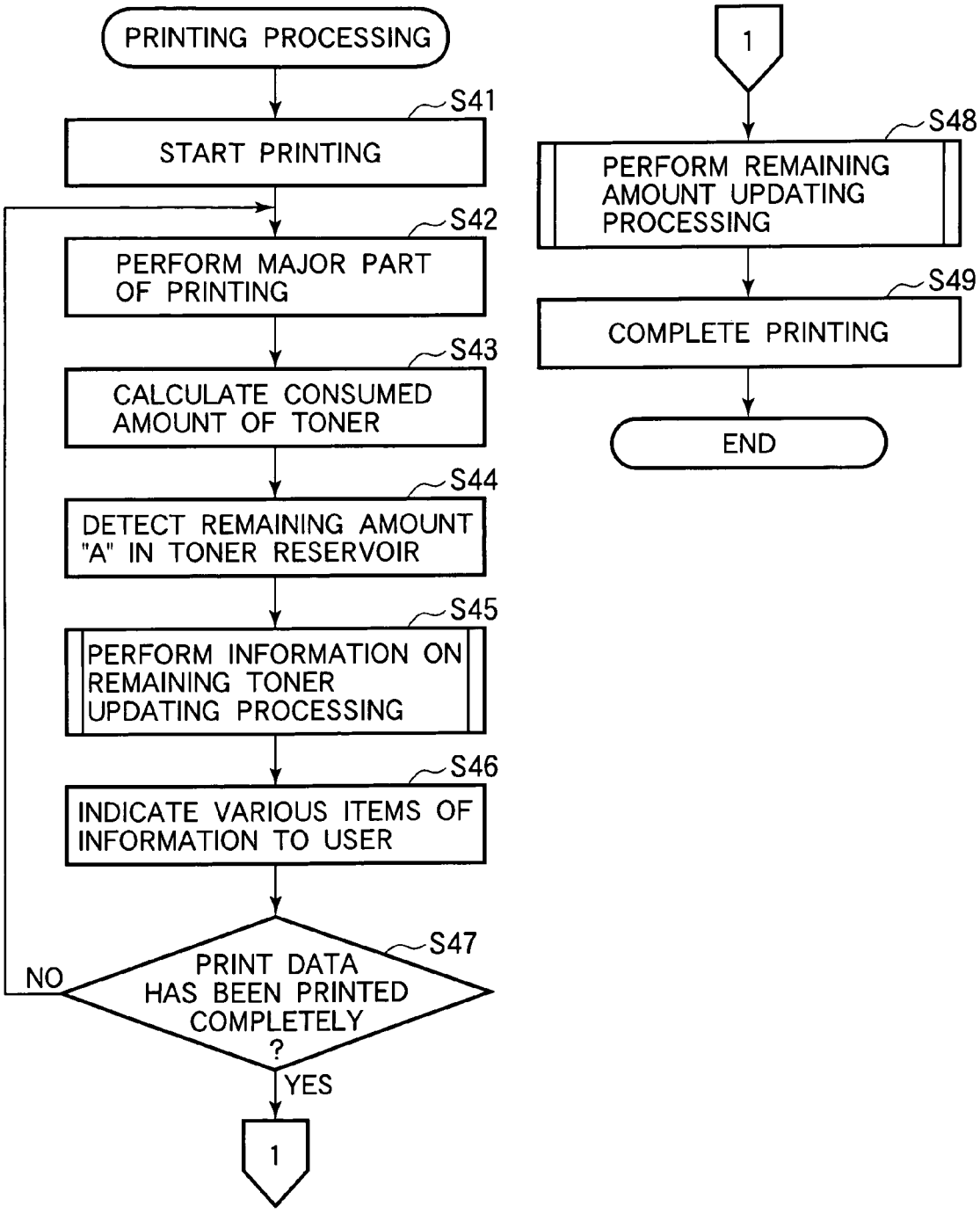
FIGS. 12 and 13 are flowcharts illustrating the operation regarding the remaining amount of toner during printing.
Figure 13:
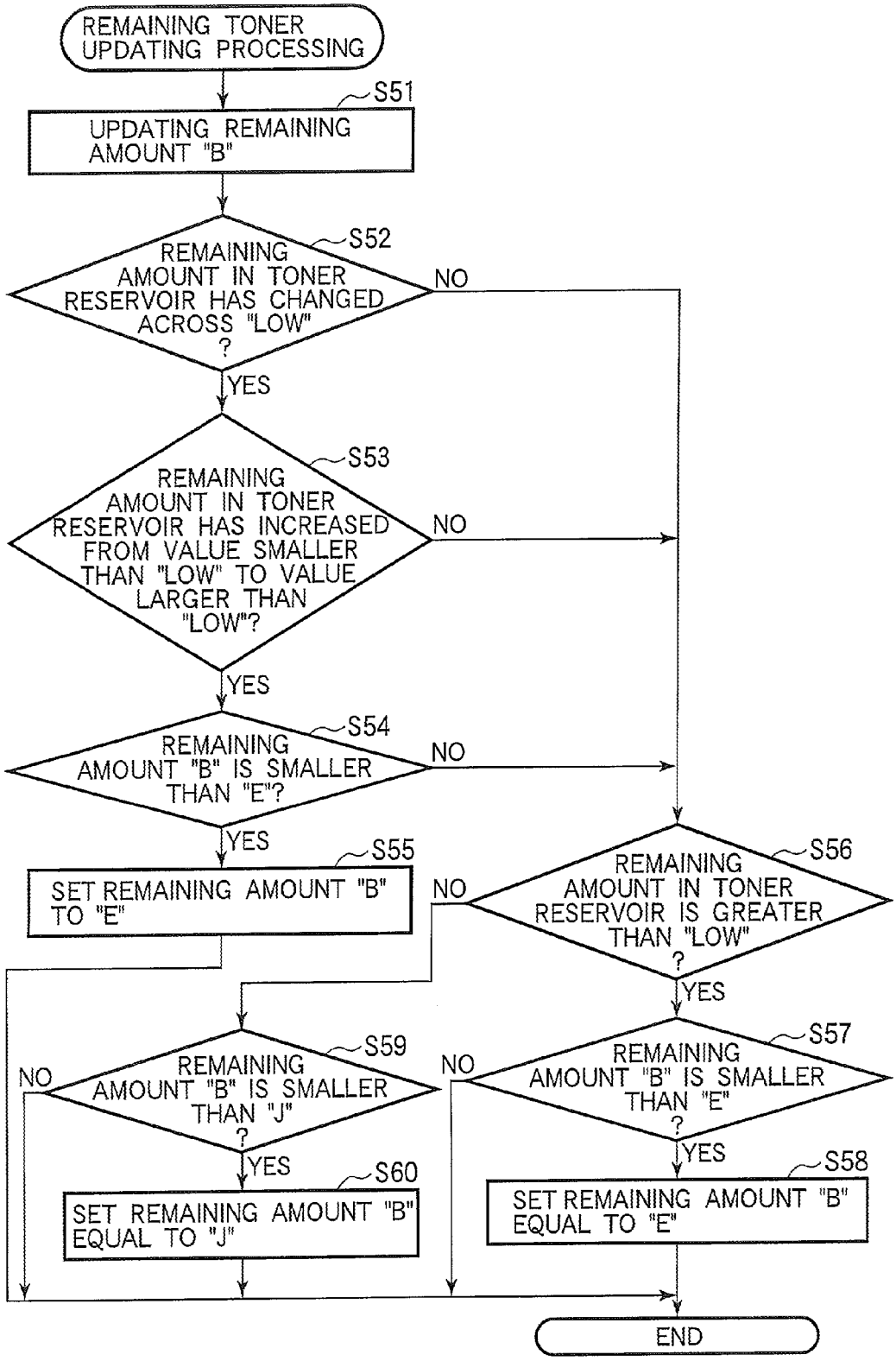

FIGS. 12 and 13 are flowchart illustrating the operation regarding the remaining amount of toner during printing.

The operation regarding the remaining amount of toner during printing in the second embodiment is the same as those described with reference to FIGS. 12 and 13 in the first embodiment, and their detailed description is omitted. In the operation shown in FIGS. 9 and 13, if the cartridge memory 14 is detected properly, the remaining amount B (14*h*) is also updated.

Even when both the process cartridge and toner bottle are replaced, the remaining amount of toner can be accurately detected.

As described above, the present invention can be applied to image forming apparatuses in which the toner is replenished into a toner holding portion of apparatuses, for example, printers, copying machines, facsimile machines and multi function printers (MFP).

The invention being thus described, it will be obvious that the same may be varied in many ways. Such variations are not to be regarded as a departure from the scope of the invention, and all such modifications as would be obvious to one skilled in the art intended to be included within the scope of the following claims.

What is claimed is:

1. An image forming apparatus, comprising:

an image forming unit including a developer reservoir;

a first controller for calculating a consumed amount of developer material based on image data;

a developer holder attached to the image forming unit and including a developer chamber that holds the developer material therein and supplying the developer material into the developer reservoir, the developer holder including a first memory that holds first amount information on an amount of developer material remaining in the developer chamber and that holds first identification information on the developer holder;

a second memory that holds second amount information on an amount of developer material remaining in the developer reservoir and second identification information on the developer holder;

a second controller for determining whether the first identification information and second identification information coincide, wherein if the first identification information and the second identification information do not coincide, the second controller determines that the developer holder has been replaced, wherein if the second controller determines that the developer holder has been replaced, the second controller determines a remaining capacity of the developer reservoir based on the second amount information and a full capacity of the developer reservoir, compares the remaining capacity and the first amount information, and updates the first amount information and the second amount information respectively to the first amount information and the second amount information on condition that the developer material of an amount determined based on a result of comparison is supplied from the developer chamber to the developer reservoir.

2. The image forming apparatus according to claim 1, wherein if the remaining capacity of the developer reservoir is greater than the first amount information, the second controller adds the first amount information to the second amount information, and then sets the first amount information to zero;

wherein if the remaining capacity of the developer reservoir is smaller than the first amount information, the second controller subtracts the remaining capacity of the developer reservoir from the first amount information, and sets the second amount information to the full capacity of the developer reservoir.

3. The image forming apparatus according to claim 2, further comprising:

a detector for detecting whether the amount of the developer material remaining in the developer reservoir is greater than a predetermined value;

wherein, if the amount of the developer material remaining in the developer reservoir detected by the detector decreases from a value greater than the predetermined value to become a value smaller than the predetermined value, and if the second amount information is smaller than a first reference, the second controller sets the second amount information so as to be equal to the first reference;

wherein, if the amount of the developer material remaining in the developer reservoir detected by the detector is greater than the predetermined value, and if the second amount information is smaller than the first reference, the second controller sets the second amount information so as to be equal to the first reference; and wherein, if the amount of the developer material remaining in the developer reservoir detected by the detector is smaller than the predetermined value, and if the second amount information is smaller than a second reference, the second controller sets the second amount information so as to be equal to the second reference.

4. The image forming apparatus according to claim 3, wherein the first reference is an amount of developer material remaining in the developer reservoir below which print quality is degraded, and the second reference is an amount of developer material remaining in the developer reservoir below which further printing cannot be performed.

5. The image forming apparatus according to claim 3, wherein the second controller indicates information on the amount of the developer material remaining in the developer reservoir to a user.

6. The image forming apparatus according to claim 1, further comprising:

a detector for detecting whether the amount of the developer material remaining in the developer reservoir is greater than a predetermined value;

wherein, if the amount of the developer material remaining in the developer reservoir detected by the detector decreases from a value greater than the predetermined value to become a value smaller than the predetermined value, and if the second amount information is smaller than a first reference, the second controller sets the second amount information so as to be equal to the first reference;

wherein, if the amount of the developer material remaining in the developer reservoir detected by the detector is greater than the predetermined value, and if the second amount information is smaller than the first reference, the second controller sets the second amount information so as to be equal to the first reference; and wherein, if the amount of the developer material remaining in the developer reservoir detected by the detector is smaller than the predetermined value, and if the second amount information is smaller than a second reference, the second controller sets the second amount information so as to be equal to the second reference.

7. The image forming apparatus according to claim 6, wherein the first reference is an amount of developer material remaining in the developer reservoir below which print quality is degraded, and the second reference is an amount of developer material remaining in the developer reservoir below which further printing cannot be performed.

8. The image forming apparatus according to claim 6, wherein the second controller indicates information on the amount of the developer material remaining in the developer reservoir to a user.

9. The image forming apparatus according to claim 1, wherein the image forming unit further includes a third memory for holding third identification information that identifies the image forming unit;

wherein the first memory further holds fourth identification information that identifies the image forming unit and fifth identification information that identifies the image forming apparatus;

wherein the second memory further holds sixth identification information that identifies the image forming apparatus; and wherein if the fourth identification information held in the first memory and the third identification information held in the third memory do not coincide, and the fifth identification information held in the first memory and the sixth identification information held in the second memory do not coincide, the second controller determines that the developer holder has been replaced.

10. The image forming apparatus according to claim 9, wherein the third memory is an electronic tag.

11. The image forming apparatus according to claim 1, wherein the first memory is an electronic tag and the second memory is a flash memory.

12. The image forming apparatus according to claim 1, wherein, if the remaining capacity of the developer reservoir is smaller than the first amount information, the second controller updates the first amount information to a value obtained by subtracting the remaining capacity of the developer reservoir from the first amount information, and wherein, if the remaining capacity of the developer reservoir is larger than the first amount information, the second controller updates the second amount information to a value obtained by adding the first amount information and the second amount information.

* * * * *